US010694900B2

(12) United States Patent
Troutman et al.

(10) Patent No.: US 10,694,900 B2
(45) **Date of Patent: *Jun. 30, 2020**

(54) AUTOMATIC TOWEL DISPENSER

(71) Applicant: GPCP IP HOLDINGS LLC, Atlanta, GA (US)

(72) Inventors: William Bryant Troutman, Charlotte, NC (US); William Bryant Troutman, II, Charlotte, NC (US); Ian D. Kovacevich, Carlsbad, CA (US); Thomas James Philpott, Charlotte, NC (US); Christopher Hoy, Charlotte, NC (US); Lawrence Ober, Pineville, NC (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/283,112

(22) Filed: Feb. 22, 2019

(65) Prior Publication Data

US 2019/0183297 A1 Jun. 20, 2019

Related U.S. Application Data

(63) Continuation of application No. 15/339,920, filed on Oct. 31, 2016, now Pat. No. 10,213,069, which is a (Continued)

(51) Int. Cl.
*A47K 10/36* (2006.01)

(52) U.S. Cl.
CPC ..... *A47K 10/36* (2013.01); *A47K 10/3625* (2013.01); *A47K 2010/3668* (2013.01);

(Continued)

(58) Field of Classification Search
CPC ..... A47K 10/36; A47K 10/3625; A47K 2010/3668; A47K 2010/3681; Y10T 225/10; Y10T 225/206
See application file for complete search history.

(56) References Cited

U.S. PATENT DOCUMENTS 1,761,464 A 6/1930 Caps
2,135,767 A 11/1938 Price et al.

(Continued)

FOREIGN PATENT DOCUMENTS

CN 209712725 U 12/2019
EP 0573558 B1 12/1997

(Continued)

OTHER PUBLICATIONS

International Search Report and Written Opinion of the International Search Authority (Korean Intellectual Property Office) for International Patent Application Serial No. PCT/US2010/037561, dated Jan. 10, 2011.

(Continued)

*Primary Examiner* — William A. Rivera
(74) *Attorney, Agent, or Firm* — Nelson Mullins Riley & Scarborough LLP

(57) ABSTRACT

Dispensing towels includes, using a motor assembly configured to cause a leading edge of the toweling to be extended from a housing of the dispenser and to cause the toweling to be subsequently retracted back into the housing, (a) the step of extending the toweling exterior of the housing for grasping by a user; and (b) subsequent thereto, the steps of (1) retracting the toweling into the housing using the motor assembly; (2) sensing a leading edge of the toweling, using a sensor, while retracting the toweling; and (3) ceasing retracting of the toweling into the housing using the motor assembly as a function of sensing the leading edge of the toweling using the sensor. The toweling is advanced by the (Continued)

motor assembly such that a line of perforations in the toweling, along which the user tears the toweling, is located downstream of the sensor.

20 Claims, 20 Drawing Sheets

Related U.S. Application Data continuation of application No. 14/035,944, filed on Sep. 24, 2013, now Pat. No. 9,480,370, which is a continuation of application No. 12/861,804, filed on Aug. 23, 2010, now Pat. No. 8,632,030, which is a continuation-in-part of application No. 12/795,384, filed on Jun. 7, 2010, now abandoned, which is a continuation-in-part of application No. PCT/US2010/037561, filed on Jun. 6, 2010, and a continuation-in-part of application No. PCT/US2010/037561, filed on Jun. 6, 2010.

(60) Provisional application No. 61/266,169, filed on Dec. 3, 2009, provisional application No. 61/184,789, filed on Jun. 6, 2009.

(52) U.S. Cl.
CPC ..... *A47K 2010/3681* (2013.01); *Y10T 225/10* (2015.04); *Y10T 225/206* (2015.04)

(56) References Cited

U.S. PATENT DOCUMENTS

| | | | |
|---|---|---|---|
| 2,193,759 | A | 3/1940 | Birr |
| RE22,565 | E | 11/1944 | Gillanders et al. |
| 2,487,763 | A | 11/1949 | Patterson et al. |
| 3,575,328 | A | 4/1971 | Jespersen et al. |
| 3,730,409 | A | 5/1973 | Ratti |
| RE28,911 | E | 7/1976 | Jespersen et al. |
| 4,131,044 | A | 12/1978 | Cassia |
| 4,137,805 | A | 2/1979 | DeLuca et al. |
| 4,142,431 | A | 3/1979 | Jespersen |
| 4,188,844 | A | 2/1980 | DeLuca |
| 4,191,307 | A | 3/1980 | LeClaire, Jr. et al. |
| 4,203,562 | A | 5/1980 | DeLuca et al. |
| 4,206,858 | A | 6/1980 | DeLuca et al. |
| 4,236,679 | A | 12/1980 | Jespersen |
| 4,286,489 | A | 9/1981 | DeLuca |
| 4,307,638 | A | 12/1981 | DeLuca et al. |
| 4,307,639 | A | 12/1981 | DeLuca |
| 4,340,195 | A | 7/1982 | DeLuca |
| 4,404,880 | A | 9/1983 | DeLuca |
| 4,611,768 | A | 9/1986 | Voss et al. |
| 4,666,099 | A | 5/1987 | Hoffman et al. |
| 4,738,176 | A | 4/1988 | Cassia |
| 4,817,483 | A | 4/1989 | Armbruster |
| 4,848,690 | A | 7/1989 | Lemoine |
| 4,856,724 | A | 8/1989 | Jespersen |
| 4,944,466 | A | 7/1990 | Jespersen |
| D312,369 | S | 11/1990 | DeLuca et al. |
| 4,984,530 | A | 1/1991 | Dutton |
| D316,788 | S | 5/1991 | Fischer et al. |
| 5,020,403 | A | 6/1991 | D'Angelo et al. |
| 5,048,386 | A | 9/1991 | DeLuca et al. |
| 5,078,033 | A | 1/1992 | Formon |
| 5,107,734 | A | 4/1992 | Armbruster |
| 5,137,173 | A | 8/1992 | Hughes et al. |
| 5,249,755 | A | 10/1993 | Jespersen |
| 5,271,574 | A | 12/1993 | Formon et al. |
| 5,288,032 | A | 2/1994 | Boone et al. |
| 5,294,192 | A | 3/1994 | Omdoll et al. |
| 5,305,937 | A | 4/1994 | Barnett |
| 5,314,131 | A | 5/1994 | McCanless et al. |
| 5,375,785 | A | 12/1994 | Boone et al. |
| 5,441,189 | A | 8/1995 | Formon et al. |
| 5,452,832 | A | 9/1995 | Niada |
| 5,526,973 | A | 6/1996 | Boone et al. |
| 5,558,302 | A | 9/1996 | Jesperson |
| 5,601,253 | A | 2/1997 | Formon et al. |
| 5,765,717 | A | 6/1998 | Gottselig |
| 5,772,291 | A | 6/1998 | Byrd et al. |
| 5,924,617 | A | 7/1999 | LaCount et al. |
| 5,979,821 | A | 11/1999 | LaCount et al. |
| 5,979,822 | A | 11/1999 | Morand et al. |
| D419,014 | S | 1/2000 | Fluegge et al. |
| D419,805 | S | 2/2000 | Fluegge et al. |
| 6,032,898 | A | 3/2000 | LaCount et al. |
| 6,105,898 | A | 8/2000 | Byrd et al. |
| 6,152,397 | A | 11/2000 | Purcell |
| 6,161,796 | A | 12/2000 | Daniels |
| 6,237,871 | B1 | 5/2001 | Morand et al. |
| 6,250,530 | B1 | 6/2001 | LaCount et al. |
| 6,354,533 | B1 | 3/2002 | Jespersen |
| 6,412,679 | B2 | 7/2002 | Formon et al. |
| 6,419,136 | B2 | 7/2002 | Formon et al. |
| 6,554,158 | B2 | 4/2003 | Kapiloff et al. |
| 6,607,160 | B2 | 8/2003 | Lewis et al. |
| 6,695,246 | B1 | 2/2004 | Elliot et al. |
| 6,710,606 | B2 | 3/2004 | Morris |
| 6,736,348 | B1 | 5/2004 | Formon et al. |
| 6,736,466 | B1 | 5/2004 | Helland et al. |
| 6,742,689 | B2 | 6/2004 | Formon et al. |
| 6,745,927 | B2 | 6/2004 | Formon et al. |
| 6,758,434 | B2 | 7/2004 | Kapiloff et al. |
| 6,766,977 | B2 | 7/2004 | Denen et al. |
| 6,826,985 | B2 | 12/2004 | Broehl |
| 6,826,991 | B1 | 12/2004 | Rasmussen |
| 6,830,210 | B2 | 12/2004 | Formon et al. |
| 6,854,684 | B2 | 2/2005 | Byrd et al. |
| 6,871,815 | B2 | 3/2005 | Moody et al. |
| 6,902,134 | B2 | 6/2005 | Green et al. |
| 6,903,654 | B2 | 6/2005 | Hansen et al. |
| 6,929,213 | B1 | 8/2005 | Contreras |
| 6,952,067 | B2 | 10/2005 | Tanaka et al. |
| 6,959,891 | B2 | 11/2005 | Kapiloff et al. |
| 6,964,395 | B1 | 11/2005 | Lewis et al. |
| 6,988,689 | B2 | 1/2006 | Thomas et al. |
| 6,994,408 | B1 | 2/2006 | Bunnell |
| 7,017,856 | B2 | 3/2006 | Moody et al. |
| 7,040,566 | B1 | 5/2006 | Rodrian et al. |
| 7,040,567 | B1 | 5/2006 | Lewis et al. |
| D522,781 | S | 6/2006 | Wieser et al. |
| 7,114,677 | B2 | 10/2006 | Formon et al. |
| 7,168,602 | B2 | 1/2007 | Broehl |
| 7,182,289 | B2 | 2/2007 | Moody et al. |
| 7,185,841 | B2 | 3/2007 | Kaufmann |
| 7,185,842 | B2 | 3/2007 | Lewis et al. |
| 7,191,977 | B2 | 3/2007 | Denen et al. |
| 7,219,852 | B2 | 5/2007 | Tramontina et al. |
| 7,237,744 | B2 | 7/2007 | Morris et al. |
| D550,999 | S | 9/2007 | Formon et al. |
| 7,296,765 | B2 | 11/2007 | Rodrian |
| D564,269 | S | 3/2008 | Paal et al. |
| 7,338,008 | B1 | 3/2008 | Jenkins |
| 7,341,170 | B2 | 3/2008 | Boone |
| 7,347,134 | B2 | 3/2008 | Lewis et al. |
| 7,387,274 | B2 | 6/2008 | Moody et al. |
| 7,406,901 | B2 | 8/2008 | Schmidt et al. |
| 7,438,256 | B2 | 10/2008 | Nip et al. |
| 7,530,524 | B2 | 5/2009 | Wieser et al. |
| 7,533,845 | B2 | 5/2009 | Neveu et al. |
| 7,553,098 | B2 | 6/2009 | Maekawa et al. |
| 7,568,652 | B2 | 8/2009 | Cittadino et al. |
| 7,594,622 | B2 | 9/2009 | Witt et al. |
| 7,624,664 | B2 | 12/2009 | Morris et al. |
| 7,698,980 | B2 | 4/2010 | Morris |
| 7,774,096 | B2 | 8/2010 | Goerg et al. |
| 7,783,380 | B2 | 8/2010 | York et al. |
| 7,821,155 | B2 | 10/2010 | Reinsel et al. |
| 7,832,679 | B2 | 11/2010 | Denen et al. |
| 7,845,593 | B2 | 12/2010 | Formon et al. |
| 7,878,446 | B2 | 2/2011 | Reinsel et al. |
| 7,887,005 | B2 | 2/2011 | Troutman et al. |

(56) References Cited

U.S. PATENT DOCUMENTS

| | | | |
|---|---|---|---|
| 7,946,522 | B2 | 5/2011 | Lewis et al. |
| 7,963,475 | B2 | 6/2011 | Rodrian |
| 8,079,540 | B2 | 12/2011 | Troutman et al. |
| 8,079,541 | B2 | 12/2011 | Troutman et al. |
| 8,079,542 | B2 | 12/2011 | Troutman et al. |
| 8,079,543 | B2 | 12/2011 | Troutman et al. |
| 8,083,170 | B2 | 12/2011 | Troutman et al. |
| 8,186,551 | B2 | 5/2012 | Morris |
| 8,231,075 | B2 | 7/2012 | Troutman et al. |
| 8,231,076 | B2 | 7/2012 | Troutman et al. |
| 8,240,594 | B2 | 8/2012 | Troutman et al. |
| 8,336,803 | B2 | 12/2012 | Troutman et al. |
| 8,434,709 | B2 | 5/2013 | Troutman et al. |
| 8,464,976 | B2 | 6/2013 | Mok et al. |
| 8,561,933 | B2 | 10/2013 | Troutman et al. |
| 8,632,030 | B2 | 1/2014 | Troutman et al. |
| 9,144,352 | B2 | 9/2015 | Cittadino et al. |
| 9,282,855 | B2 | 3/2016 | Troutman et al. |
| 9,307,875 | B2 | 4/2016 | Clarkin |
| 9,474,422 | B1 | 10/2016 | Troutman et al. |
| 9,480,370 | B2 | 11/2016 | Troutman et al. |
| 9,596,964 | B1 | 3/2017 | Troutman et al. |
| 9,642,503 | B1 | 5/2017 | Troutman et al. |
| D807,663 | S | 1/2018 | Taylor |
| 10,165,907 | B1 | 1/2019 | Troutman et al. |
| 10,213,069 | B2 * | 2/2019 | Troutman ..... A47K 10/36 |
| 2003/0019971 | A1 | 1/2003 | Lewis et al. |
| 2003/0168550 | A1 | 9/2003 | Formon et al. |
| 2004/0251375 | A1 | 12/2004 | Denen et al. |
| 2005/0150992 | A1 | 7/2005 | Morris et al. |
| 2005/0171634 | A1 | 8/2005 | York et al. |
| 2006/0006275 | A1 | 1/2006 | Neveu et al. |
| 2006/0138274 | A1 | 6/2006 | Goeking et al. |
| 2006/0169827 | A1 | 8/2006 | Lewis et al. |
| 2006/0173576 | A1 | 8/2006 | Goerg et al. |
| 2007/0080255 | A1 | 4/2007 | Witt et al. |
| 2007/0152010 | A1 | 7/2007 | Denen et al. |
| 2007/0158359 | A1 | 7/2007 | Rodrian |
| 2007/0194166 | A1 | 8/2007 | Reinsel et al. |
| 2008/0011772 | A1 | 1/2008 | Morris et al. |
| 2008/0018302 | A1 | 1/2008 | Reinsel et al. |
| 2008/0078777 | A1 | 4/2008 | Cittadino et al. |
| 2008/0087758 | A1 | 4/2008 | Formon et al. |
| 2008/0099595 | A1 | 5/2008 | Lewis et al. |
| 2009/0065626 | A1 | 3/2009 | Petri et al. |
| 2009/0065628 | A1 | 3/2009 | Troutman et al. |
| 2010/0219280 | A1 | 9/2010 | Troutman et al. |
| 2010/0219281 | A1 | 9/2010 | Troutman et al. |
| 2010/0219282 | A1 | 9/2010 | Troutman et al. |
| 2010/0219283 | A1 | 9/2010 | Troutman et al. |
| 2010/0219284 | A1 | 9/2010 | Troutman et al. |
| 2010/0314429 | A1 | 12/2010 | Troutman et al. |
| 2011/0068209 | A1 | 3/2011 | Troutman et al. |
| 2011/0068210 | A1 | 3/2011 | Troutman et al. |
| 2011/0068211 | A1 | 3/2011 | Troutman et al. |
| 2011/0068212 | A1 | 3/2011 | Troutman et al. |
| 2011/0068213 | A1 | 3/2011 | Troutman et al. |
| 2011/0068214 | A1 | 3/2011 | Troutman et al. |
| 2011/0068215 | A1 | 3/2011 | Troutman et al. |
| 2011/0068216 | A1 | 3/2011 | Troutman et al. |
| 2011/0068217 | A1 | 3/2011 | Troutman et al. |
| 2011/0068218 | A1 | 3/2011 | Troutman et al. |
| 2011/0068219 | A1 | 3/2011 | Troutman et al. |
| 2012/0104141 | A1 | 5/2012 | Troutman et al. |
| 2012/0305696 | A1 | 12/2012 | Troutman et al. |
| 2014/0021286 | A1 | 1/2014 | Troutman et al. |
| 2014/0021287 | A1 | 1/2014 | Troutman et al. |
| 2014/0131506 | A1 | 5/2014 | Clarkin |
| 2016/0287036 | A1 | 10/2016 | Troutman et al. |
| 2017/0042393 | A1 | 2/2017 | Troutman et al. |
| 2018/0289224 | A1 | 10/2018 | Troutman et al. |
| 2018/0317719 | A1 | 11/2018 | Troutman et al. |
| 2019/0117025 | A1 | 4/2019 | Troutman et al. |

FOREIGN PATENT DOCUMENTS

| | | | |
|---|---|---|---|
| JP | H 05-111442 | A | 5/1993 |
| JP | 2007-014367 | A | 1/2007 |
| WO | WO 1998053728 | A1 | 12/1998 |
| WO | WO 2010141931 | A3 | 3/2011 |

OTHER PUBLICATIONS

Innovia WB2-159S Automatic Paper Towel Dispenser, retrieved Feb. 1, 2018 from <https://www.amazon.com/gp/product/B008HDREZ6/ref=s9_acsd_hps_bw_cr_x_ _a_w/>.

* cited by examiner

Front Elevational View

Back Elevational View

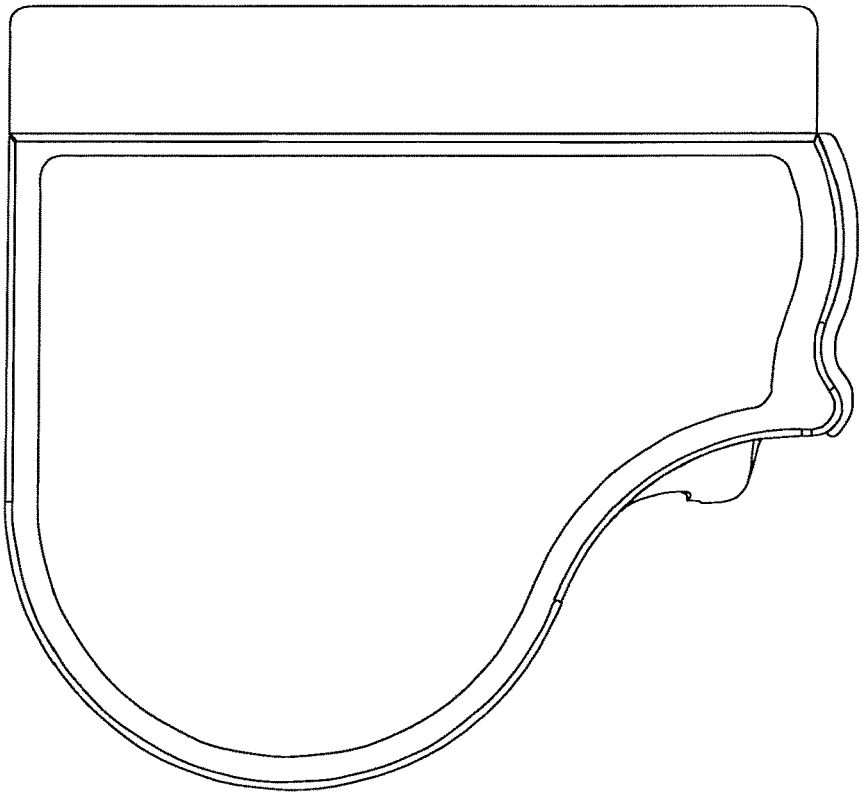
FIG. 18 Left Side Elevational View
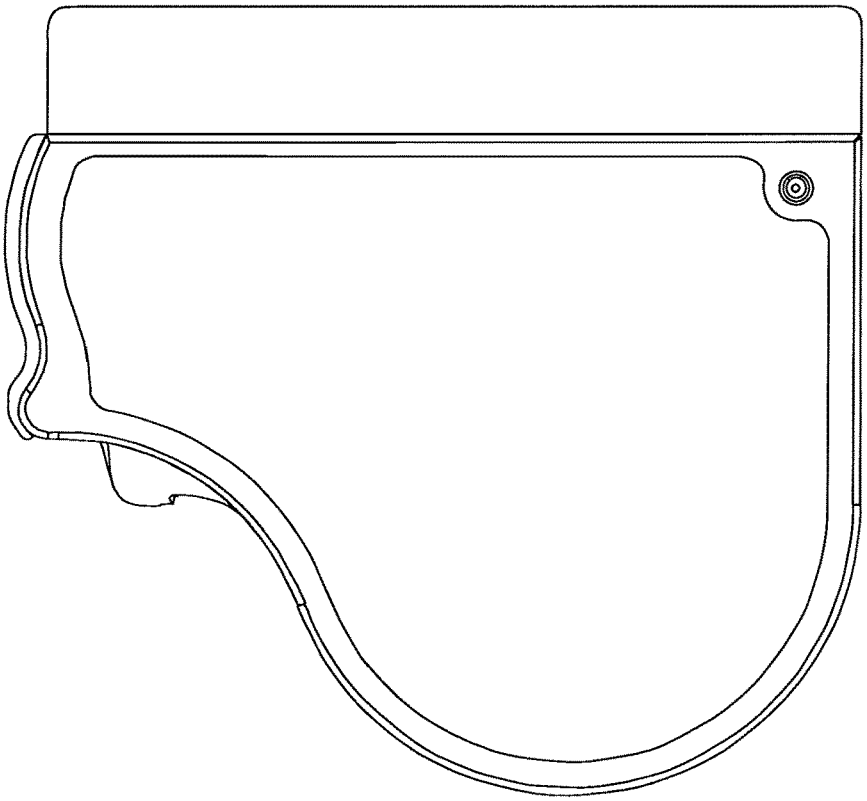
FIG. 19 Right Side Elevational View Top Plan View Top Plan View Bottom Plan View Isometric View Isometric View

AUTOMATIC TOWEL DISPENSER

CROSS-REFERENCE TO RELATED APPLICATION

The present application is a U.S. continuation of, and claims priority under 35 U.S.C. § 120 to, U.S. patent application Ser. No. 15/339,920, filed Oct. 31, 2016, which '920 application is incorporated herein by reference, and which '920 application is a continuation of, and claims priority under 35 U.S.C. § 120 to, U.S. patent application Ser. No. 14/035,944, filed Sep. 24, 2013, now U.S. Pat. No. 9,480,370, which '944 application is incorporated herein by reference, and which '944 application is a continuation of, and claims priority under 35 U.S.C. § 120 to, U.S. patent application Ser. No. 12/861,804, filed on Aug. 23, 2010, now U.S. Pat. No. 8,632,030, which '804 application is incorporated herein by reference, and which '804 application is a U.S. continuation-in-part of, and claims priority under 35 U.S.C. § 120 to:

(1) international patent application PCT/US10/37561, filed in English on Jun. 6, 2010 and designating the United States of America, expired, which international patent application is incorporated herein by reference, and which international patent application claims priority in the United States under 35 U.S.C. § 119(e) to each of,
   (a) Troutman et al. U.S. provisional patent application 61/184,789, filed on Jun. 6, 2009, which is incorporated herein by reference, and
   (b) Troutman et al. U.S. provisional patent application 61/266,169, filed on Dec. 3, 2009, which is incorporated herein by reference; and
(2) U.S. patent application Ser. No. 12/795,384, filed Jun. 7, 2010, incorporated herein by reference, abandoned, which '384 application is:
   (a) a U.S. continuation-in-part patent application of, and claims priority under 35 U.S.C. § 120 to, international patent application PCT/US10/37561, filed in English on Jun. 6, 2010 and designating the United States of America, pending, which international patent application is incorporated herein by reference, and which international patent application claims priority in the United States under 35 U.S.C. § 119(e) to each of,
      (I) Troutman et al. U.S. provisional patent application 61/184,789, filed on Jun. 6, 2009, which is incorporated herein by reference, and
      (II) Troutman et al. U.S. provisional patent application 61/266,169, filed on Dec. 3, 2009, which is incorporated herein by reference; and
   (b) a U.S. nonprovisional patent application of, and claims priority under 35 U.S.C. § 119(e) to, each of,
      (I) Troutman et al. U.S. provisional patent application 61/184,789, filed on Jun. 6, 2009, which is incorporated herein by reference, and
      (II) Troutman et al. U.S. provisional patent application 61/266,169, filed on Dec. 3, 2009, which is incorporated herein by reference.

Moreover, the Appendix hereto includes a copy of the specification and drawings of the '169 provisional application, which Appendix is incorporated herein by reference. The present application further incorporates herein by reference Troutman et al. U.S. patent application publication 2009/0065628, which published Mar. 12, 2009.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to towel dispensers and, more particularly, to towel dispensers in which a length of toweling is extended from the housing for grasping and pulling by a user for separation and dispensing of one or more towels. In preferred embodiments of the invention, the toweling comprises a roll of perforated towels, in which the towels are connected together and separable at perforation formed between the towels.

Towel dispensers are well known and generally include a housing configured to receive toweling; a guide system that defines a path within the housing and that guides the toweling along the path during movement of the toweling while towels are dispensed; and a motor that moves the toweling along the path to the exterior of the housing, thereby exteriorly extending the toweling from the housing. The guide system can include rollers or fixed guides and typically includes one or more driven rollers connected to the motor. A switch or sensor for detecting motion or proximity of an object is provided to initiate the operation of the motor. For example, in a known dispenser, a controller is electrically connected to the sensor and is configured to activate the motor when the sensor generates a signal that indicates the presence of a hand.

Conventional towel dispensers also generally are configured to dispense towels from continuous rolls of non-perforated toweling and include a device for cutting the toweling to dispense individual towels. The length of the individual towels provided by the dispenser is determined by the amount of time that the motor is operated or by measuring the individual towel as it is dispensed, and such length generally is preprogrammed into the dispensers such that the same length of toweling is automatically and consistently dispensed each time the hand-motion sensor is activated.

Conventional towel dispensers generally operate as follows. A roll of toweling is placed within the housing and threaded through the guide system. A user causes a towel to be dispensed by placing a hand or other object near the sensor. Alternatively, the dispensing of toweling can be initiated by pressing a button or switch that is configured to activate the motor. Dispensing of the toweling is stopped when a predetermined length of toweling has been dispensed. Alternatively, in some cases the toweling is stopped when the hand is removed or button/switch is released.

Conventional towel dispensers are disclosed in each of U.S. Pat. Nos. 6,412,679; 6,419,136; 6,742,689; 6,745,927; 6,766,977; and 7,191,977. Each of these patents is incorporated herein by reference.

Even in view of known towel dispensers, it is believed that one or more needs exist for improved towel dispensers.

SUMMARY OF THE INVENTION

The present invention includes many aspects and features. Moreover, while many aspects and features relate to, and are described in, the context of toweling including a roll of sheet material separated by perforations that define towels when separated, the present invention is not limited to use only in such context, and may be used with toweling that does not include such perforations. Moreover, while preferred implementations relate to dispensing of paper towels, the invention is not limited to such implementations and is applicable, for example, in implementations relating to the dispensing of toilet paper or other types of toweling.

Accordingly, in an aspect of the invention, a method of dispensing towels from toweling with a dispenser includes: (a) using a motor assembly configured to cause a leading edge of the toweling to be extended from a housing of the dispenser and to cause the toweling to be subsequently retracted back into the housing, the step of extending the toweling exterior of the housing for grasping by a user; and subsequent thereto, the steps of (b) the step of retracting the toweling into the housing using the motor assembly; the step of sensing a leading edge of the toweling, using a sensor, while retracting the toweling; and the step of ceasing retracting of the toweling into the housing using the motor assembly as a function of sensing the leading edge of the toweling using the sensor. Moreover, it will be understood that reference to a "trailing edge" in the context of sensing an edge of the toweling during retraction is, in fact, the "leading edge" of the toweling extending out of the housing. As such, it will be understood that in this context "trailing edge" and "leading edge" may be synonymous.

In a feature of this aspect, the housing includes a main body and a loading door. The loading door is configured to rotate relative to the main body between a closed position, in which the housing is configured to extend toweling there from, and an open position, in which the housing is configured to receive toweling therein. Furthermore, the loading door includes a towel carrier having a curved surface defining a cavity within which toweling comprising a roll of paper towels is received and retained in floating engagement therewith. The roll of paper towels rolls and slides on the curved surface when unwinding during said step of extending the toweling exterior of the housing for grasping by a user. Moreover, the toweling gathers within the housing during retracting of the toweling into the housing and does not wind back onto the roll of paper towels. Preferably, the toweling bunches within the housing.

In another feature of the invention, the housing includes a main body, a loading door, and a guide system. The loading door is configured to rotate relative to the main body between a closed position, in which the housing is configured to extend toweling there from, and an open position, in which the housing is configured to receive toweling therein. The guide system is configured to guide the toweling within the housing during extension from and retraction into the housing of the toweling. The guide system includes a first roller attached to the main body and a second roller attached to the loading door. Moreover, the first roller preferably has a toothed surface that is configured to mesh with a toothed surface of the second roller. Furthermore, at least one end of the first roller moves such that an axis of rotation of the first roller moves relative to the main body of the housing. In this feature, the method further includes the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position.

In another feature, the housing includes extension walls located proximate opposite exterior sides of the housing that extend above a top side of the housing. In this feature, the method includes a preliminary step of mounting the dispenser to the underside of a fixture, including removing a portion of each extension wall along a score line so as to adjust the distance from the underside of the fixture below which the top side of the housing is mounted. In some embodiments including this feature, but not all such embodiments, the fixture is a cabinet mounted to a wall or suspended from a ceiling. In some embodiments including this feature, but not all such embodiments, the fixture is a shelf that is mounted to a wall.

In another feature of this aspect, the toweling comprises a roll of paper towels and the dispenser is configured to unwind roll of paper towels during extension of toweling from the housing but not rewind the roll of paper towels during subsequent retraction of toweling into the housing. Furthermore, a back side of the housing includes an opening that is configured such that excess toweling gathering within the housing may fall there through as a result of retraction of toweling back into the housing.

In another feature, the toweling comprises towels that are connected together and that are separable at perforations formed there between. In this respect, the toweling preferably comprises a roll of perforated paper towels. The roll of paper towels generally may be any of those commercially available for consumer purchase, like those from companies such as Proctor & Gamble and Kimberly Clark. With further regard to this feature, the step of extending the toweling exterior of the housing for grasping by the user further preferably includes extending a sufficient length of the toweling such that at least one line of perforations is located outside of the housing whereby tearing along the line of perforations leaves a residual extent of the toweling extending outside of the housing after tearing.

In another feature, the step of extending the toweling exterior of the housing for grasping by the user comprises extending the toweling a predetermined unit length beyond the point at which the sensor detects the leading edge of the toweling. In some embodiments including this feature, but not all such embodiments, this includes extending the toweling an extent that is less than the predetermined unit length such that at least one line of perforations is located outside of the housing, whereby tearing along the line of perforations leaves a residual extent of the toweling extending outside of the housing after tearing; and may even include further extending the toweling another predetermined unit length beyond the point at which the sensor detects the leading edge of the toweling. Furtherinore, in at least some embodiments, the step of extending the toweling exterior of the housing for grasping by the user may be performed in response to the sensing of a hand proximate the dispenser.

With regard to this feature, the method in at least some embodiments, but not all, further includes setting the predetermined unit length, by which the toweling is extended, in a length learn sequence. The length learn sequence preferably includes: (i) retracting the toweling until a leading edge of the toweling is sensed by the sensor; (ii) advancing the toweling a preset extended length, the preset extended length being greater than at least a distance between immediately adjacent lines of perforations in the toweling; (iii) retracting the toweling until a leading edge of the toweling is sensed by the sensor while measuring a length by which the toweling is retracted; and (iv) determining the difference between the preset extended length and the measured retracted length, the difference being the predetermined unit length. The preset extended length may be greater than twice the distance between immediately adjacent lines of perforations in the toweling, whereby the predetermined unit length may be set for dispensing up to two towels at a time; may be greater than three times the distance between immediately adjacent lines of perforations in the toweling, whereby the predetermined unit length may be set for dispensing up to three towels at a time; and may be greater than four times the distance between immediately adjacent lines of perforations in the toweling, whereby the predetermined unit length may be set for dispensing up to four towels at a time. The length learn sequence of the dispenser may be initiated by installing a roll of paper towels in the dispenser. This is preferably accomplished by moving a loading door of the dispenser, through which a roll of paper towels is received, to a closed position, with a length of the toweling preferably being draped over and extending from the loading door.

In still another feature of this aspect, the motor assembly includes a motor and a controller that is configured to control operation of the motor and the subsequent extension of the toweling from and retraction of the toweling into the housing. With regard to this feature, the method preferably includes the step of: measuring extension of the toweling from the housing; measuring retraction of the toweling into the housing; or both. In some embodiments including this feature, but not all such embodiments, such measuring is performed using an encoder pinwheel that rotates during extension and retraction of the toweling. In some embodiments including this feature, but not all such embodiments, such measuring is performed using an LED component, complementary metal oxide semiconductor (CMOS) component, and digital signal processor (DSP) component; or a laser component, complementary metal oxide semiconductor (CMOS) component, and digital signal processor (DSP) component. Moreover, the sensor for detecting the leading edge of the toweling may be comprised of the LED component, complementary metal oxide semiconductor (CMOS) component, and digital signal processor (DSP); or may be comprised of the laser component, complementary metal oxide semiconductor (CMOS) component, and digital signal processor (DSP) component.

In another feature, the loading door of the dispenser includes a guiding surface along which toweling rides when retracted into the housing. The guiding surface forms a backdrop that is dark and contrasts well with the toweling so as to better define the leading edge of the toweling for sensing by the sensor.

In another aspect of the invention, a towel dispenser includes: a housing for receiving toweling comprising a roll of paper towels; a motor assembly configured to cause a leading edge of the toweling to be extended from the housing and to cause the toweling to be retracted into the housing after the leading edge has been extended; and a sensor for sensing a leading edge of the toweling during retraction of the toweling by the motor assembly. The sensor is configured to cause the motor assembly to cease retracting the toweling into the housing as a function of the sensing of the leading edge of the toweling during retraction of the toweling into the housing.

In a feature of this aspect, the housing includes a main body and a loading door. The loading door is configured to rotate relative to the main body between a closed position, in which the housing is configured to extend toweling there from, and an open position, in which the housing is configured to receive toweling therein. The loading door comprises a towel carrier having a curved surface defining a cavity configured to receive the roll of paper towels in floating engagement therewith such that the roll of paper towels rolls and slides on the curved surface during unwinding.

In another feature of this aspect, the housing comprises a main body, a loading door, and a guide system. The loading door is configured to rotate relative to the main body between a closed position, in which the housing is configured to extend toweling there from, and an open position, in which the housing is configured to receive toweling therein. The guide system is configured to guide the toweling within the housing during extension from and retraction into the housing of the toweling, and includes a first roller attached to the main body and having a first toothed surface, and a second roller attached to the loading door and having a second toothed surface that is configured to mesh with the first toothed surface. At least one end of the first roller moves such that an axis of rotation of the first roller moves relative to the main body of the housing. Moreover, the first roller is spring biased toward engagement with the second roller when the loading door is in the closed position, and the toothed surfaces of the first roller and the second roller mesh together when the loading door moves into the closed position from the open position and do not preclude the loading door from moving into the closed position from the open position.

In another feature, the housing further comprises extension walls located proximate opposite exterior sides of the housing that extends above a top side of the housing. Each extension wall includes a weakened line extending parallel to a weakened line of the other extension walls, whereby the extent above the top side at which each extension walls extends may be changed. The extent represents a distance from the underside of a cabinet below which the top side of the housing is mounted when the towel dispenser is installed under a cabinet. In some embodiments including this feature, but not all such embodiments, a back side of the housing includes an opening configured to pennit excess toweling to fall during retraction of the toweling back into the housing.

In a feature, the motor assembly comprises a motor and a controller configured to control operation of the motor and the subsequent extension of the toweling from and retraction of the toweling into the housing.

In a feature, the motor assembly is configured to cause a line of perforations of the toweling to be extended from the housing such that whereby tearing along the line of perforations leaves a residual extent of the toweling extending outside of the housing after tearing. In some embodiments including this feature, but not all such embodiments, the motor assembly is further configured to cause the residual extent of the toweling to be retracted into the housing after tearing.

In another feature, the motor assembly is configured to cause the toweling to be extended a predetermined unit length beyond the point at which the sensor detects the leading edge of the toweling. In some embodiments including this feature, but not all such embodiments, the motor assembly is configured to cause the toweling to be further extended an extent that is less than the predetermined unit length in response to the sensing of a hand proximate the dispenser. In some embodiments including this feature, but not all such embodiments, the motor assembly is configured to cause the toweling to be further extended an extent that is less than the predetermined unit length such that at least one line of perforations is located outside of the housing, whereby tearing along the line of perforations leaves a residual extent of the toweling extending outside of the housing after tearing. Furthermore, the motor assembly also may be configured to cause the toweling to be further extended another predetermined unit length beyond the point at which the sensor detects the leading edge of the toweling. The toweling may be further extended another predetermined unit length in response to the continued sensing of the hand proximate the dispenser.

The predetermined unit length, by which the toweling is extended, preferably is set in a length learn sequence. This length learn sequence preferably includes the steps of: (i) retracting the toweling until a leading edge of the toweling is sensed by the sensor; (ii) advancing the toweling a preset extended length, the preset extended length being greater than at least a distance between immediately adjacent lines of perforations in the toweling; (iii) retracting the toweling until a leading edge of the toweling is sensed by the sensor while measuring a length by which the toweling is retracted; and (iv) determining the difference between the preset extended length and the measured retracted length, the difference being the predetermined unit length. The preset extended length may be greater than twice the distance between immediately adjacent lines of perforations in the toweling, whereby the predetermined unit length may be set for dispensing up to two towels at a time; may be greater than three times the distance between immediately adjacent lines of perforations in the toweling, whereby the predetermined unit length may be set for dispensing up to three towels at a time; or may be greater than four times the distance between immediately adjacent lines of perforations in the toweling, whereby the predetermined unit length may be set for dispensing up to four towels at a time. The length learn sequence of the dispenser may be initiated by installing a roll of paper towels in the dispenser. This is preferably accomplished by moving a loading door of the dispenser, through which a roll of paper towels is received, to a closed position, with a length of the toweling preferably being draped over and extending from the loading door.

In still another feature of this aspect, the motor assembly includes a motor and a controller that is configured to control operation of the motor and the subsequent extension of the toweling from and retraction of the toweling into the housing. With regard to this feature, the method preferably includes the step of: measuring extension of the toweling from the housing; measuring retraction of the toweling into the housing; or both. In some embodiments including this feature, but not all such embodiments, such measuring is performed using an encoder pinwheel that rotates during extension and retraction of the toweling. In some embodiments including this feature, but not all such embodiments, such measuring is performed using an LED component, complementary metal oxide semiconductor (CMOS) component, and digital signal processor (DSP) component; or a laser component, complementary metal oxide semiconductor (CMOS) component, and digital signal processor (DSP) component. Moreover, the sensor for detecting the leading edge of the toweling may be comprised of the LED component, complementary metal oxide semiconductor (CMOS) component, and digital signal processor (DSP); or may be comprised of the laser component, complementary metal oxide semiconductor (CMOS) component, and digital signal processor (DSP) component.

In a feature, a loading door of the dispenser comprises a guiding surface along which toweling rides when retracted into the housing, the guiding surface framing a backdrop that is dark and contrasts well with the toweling so as to better define the leading edge of the toweling for sensing by the sensor.

In a feature, the loading door further comprises a guiding surface along which toweling rides when being extended from or retracted into the housing. In some embodiments including this feature, but not all such embodiments, the guiding surface forms a backdrop to the toweling that is dark and contrasts well so as to better define the leading edge of the toweling for sensing by the sensor.

In another feature of this aspect, the towel dispenser includes a sensor for detecting movement of the loading door out of the closed position.

In another aspect, a method of dispensing towels from toweling with a dispenser includes the steps of extending the toweling exterior of the housing for grasping by a user; and subsequent thereto, retracting the toweling into the housing. The housing includes a main body and a loading door that is configured to rotate relative to the main body between a closed position, in which the housing is configured to extend toweling there from, and an open position, in which the housing is configured to receive toweling therein. Furthermore, the loading door comprises a towel carrier that has a curved surface defining a cavity within which toweling comprising a roll of paper towels is received and retained in floating engagement therewith such that the roll of paper towels rolls and slides on the curved surface when unwinding during said step of extending the toweling exterior of the housing for grasping by a user. In some embodiments including this feature, but not all such embodiments, the toweling gathers within the housing during said step of retracting the toweling into the housing, and the toweling is not wound back onto the roll of paper towels.

In another feature of this aspect, the housing further comprises a guide system that is configured to guide the toweling within the housing during extension from and retraction into the housing of the toweling. The guide system comprising a first roller attached to the main body and having a first toothed surface, and a second roller attached to the loading door and having a second toothed surface that is configured to mesh with the first toothed surface. At least one end of the first roller moves such that an axis of rotation of the first roller moves relative to the main body of the housing, and the method further comprises the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position. In some embodiments including this feature, but not all such embodiments, the dispenser further comprises a motor assembly configured to cause a leading edge of the toweling to be extended from a housing of the dispenser and to cause the toweling to be subsequently retracted back into the housing, and both of the steps of extending the toweling exterior of the housing for grasping by a user and the step of retracting the toweling into the housing are accomplished using the motor assembly. The method further comprising the steps of sensing a leading edge of the toweling while retracting the toweling into the housing, and ceasing retracting of the toweling into the housing as a function of sensing the leading edge of the toweling.

In a feature, the housing comprises extension walls located proximate opposite exterior sides of the housing that extend above a top side of the housing, and wherein the method further comprises a preliminary step of mounting the dispenser to the underside of a fixture, including removing a portion of each extension wall along a score line so as to adjust the distance from the underside of the fixture below which the top side of the housing is mounted. In some embodiments including this feature, but not all such embodiments, the dispenser further comprises a motor assembly configured to cause a leading edge of the toweling to be extended from a housing of the dispenser and to cause the toweling to be subsequently retracted back into the housing, both of the steps of extending the toweling exterior of the housing for grasping by a user and the step of retracting the toweling into the housing being accomplished using the motor assembly; and the method further comprising the steps of sensing a leading edge of the toweling while retracting the toweling into the housing, and ceasing retracting of the toweling into the housing as a function of sensing the leading edge of the toweling.

In a feature, the toweling comprises a roll of paper towels and the dispenser is configured to unwind roll of paper towels during extension of toweling from the housing but not rewind the roll of paper towels during subsequent retraction of toweling into the housing, and a back side of the housing includes an opening that is configured such that excess toweling gathering within the housing may fall as a result of retraction of toweling back into the housing. In some embodiments including this feature, but not all such embodiments, the dispenser further comprises a motor assembly configured to cause a leading edge of the toweling to be extended from a housing of the dispenser and to cause the toweling to be subsequently retracted back into the housing, and both of the steps of extending the toweling exterior of the housing for grasping by a user and the step of retracting the toweling into the housing are accomplished using the motor assembly; and the method further comprising the steps of sensing a leading edge of the toweling while retracting the toweling into the housing, and ceasing retracting of the toweling into the housing as a function of sensing the leading edge of the toweling.

In another aspect, a towel dispenser includes: a housing for receiving toweling and a guide system that is configured to guide the toweling within the housing while towels are dispensed from the housing. The housing includes a main body and a loading door that is configured to rotate relative to the main body between a closed position, in which the housing is configured to dispense towels there from, and an open position, in which the housing is configured to receive toweling therein. Furthermore, the loading door comprises a towel carrier having a curved surface defining a cavity configured to receive the roll of paper towels in floating engagement therewith such that the roll of paper towels rolls and slides on the curved surface during unwinding. In some embodiments including this feature, but not all such embodiments, the housing further comprises a guide system that is configured to guide the toweling within the housing during extension from and retraction into the housing of the toweling. The guide system comprises a first roller attached to the main body and having a first toothed surface, and a second roller attached to the loading door and having a second toothed surface that is configured to mesh with the first toothed surface. At least one end of the first roller moves such that an axis of rotation of the first roller moves relative to the main body of the housing, and the first roller is spring biased toward engagement with the second roller when the loading door is in the closed position. Moreover, the toothed surfaces of the first roller and the second roller mesh together when the loading door moves into the closed position from the open position and do not preclude the loading door from moving into the closed position from the open position. Also, in some of these embodiments, the housing further comprises a motor assembly and a sensor. The motor assembly is configured to cause a leading edge of the toweling to be extended from the housing and to cause the toweling to be retracted into the housing after the leading edge has been extended. The sensor senses a leading edge of the toweling during retraction of the toweling by the motor assembly, and the sensor is configured to cause the motor assembly to cease retracting the toweling into the housing as a function of the sensing of the leading edge of the toweling during retraction of the toweling into the housing.

In another feature of this aspect, the housing further comprises extension walls located proximate opposite exterior sides of the housing that extends above a top side of the housing, each extension wall comprising a weakened line extending parallel to a weakened line of the other extension walls, whereby the extent above the top side at which each extension walls extends may be changed, the extent representing a distance from the underside of a fixture below which the top side of the housing is mounted when the towel dispenser is installed under the fixture. In some embodiments including this feature including this feature, but not all such embodiments, the housing further comprises a motor assembly and a sensor. The motor assembly is configured to cause a leading edge of the toweling to be extended from the housing and to cause the toweling to be retracted into the housing after the leading edge has been extended. The sensor senses a leading edge of the toweling during retraction of die toweling by the motor assembly, and the sensor is configured to cause the motor assembly to cease retracting the toweling into the housing as a function of the sensing of the leading edge of the toweling during retraction of the toweling into the housing.

In another feature, a back side of the housing includes an opening configured to permit excess toweling to fall during retraction of the toweling back into the housing. In some embodiments including this feature, but not all such embodiments, the housing further comprises a motor assembly and a sensor. The motor assembly is configured to cause a leading edge of the toweling to be extended from the housing and to cause the toweling to be retracted into the housing after the leading edge has been extended. The sensor senses a leading edge of the toweling during retraction of the toweling by the motor assembly, and the sensor is configured to cause the motor assembly to cease retracting die toweling into the housing as a function of the sensing of the leading edge of the toweling during retraction of the toweling into the housing.

In still another feature of this aspect, the guide system comprises a first roller attached to the main body and a second roller attached to the loading door. In some embodiments including this feature, but not all such embodiments, the second roller is the only roller of the guide system affixed to the loading door. In some embodiments including this feature, but not all such embodiments, the second roller comprises a lower drive roller of the guide system, and the first roller comprises an upper drive roller of the guide system, the lower drive roller engaging the upper drive roller with toweling extending there between when the loading door is moved into the closed position with toweling draped over the loading door. Also, in some embodiments including this feature, but not all such embodiments, the loading door has a second curved surface that defines a second cavity within which the second roller is retained. Additionally, the loading door may include a first component, a surface of which comprises the curved surface defining the cavity within which the roll of paper towels is received and retained, and a second component, a surface of which comprises the second curved surface defining the second cavity within which the second roller is retained, wherein the second component is affixed to the first component. Furthermore, in this regard, the second component may further define a guiding surface along which toweling rides when extended from the housing.

In another feature of this aspect, the towel dispenser further comprises a sensor that is mounted to the main body and configured to sense a leading edge of the toweling between a gap formed by the main body and the loading door when the loading door is in the closed position. In some embodiments incorporating this feature, but not all such embodiments, the loading door comprises a guiding surface that provides a backdrop to toweling, the sensor sensing the leading edge of the toweling against the backdrop of the guiding surface of the loading door. The sensor may comprise a sensor array. Also, In some embodiments incorporating this feature, but not all such embodiments, the guide system comprises a first roller attached to the main body and a second roller attached to the loading door. The second roller may be the only roller of the guide system on the loading door; the loading door may have a second curved surface defining a second cavity within which the second roller is received and retained; and the loading door may comprise a first component, a surface of which comprises the curved surface defining the cavity within which the roll of paper towels is received and retained, and a second component affixed to the first component, a surface of the second component comprising the second curved surface defining the second cavity within which the second roller is received and retained. The second component also further may define a guiding surface against which toweling rides when extended from the housing.

In another aspect of the invention, a method of dispensing towels from toweling with a dispenser includes the steps of extending the toweling exterior of the housing for grasping by a user; and subsequent thereto, retracting the toweling into the housing. In this regard, the housing comprises a main body, a loading door, and a guide system. The loading door is configured to rotate relative to the main body between closed position, in which the housing is configured to extend toweling there from, and an open position, in which the housing is configured to receive toweling therein. The guide system is configured to guide the toweling within the housing during extension from and retraction into the housing of the toweling, and comprises a first roller attached to the main body and having a first toothed surface, and a second roller attached to the loading door and having a second toothed surface that is configured to mesh with the first toothed surface. At least one end of the first roller moves such that an axis of rotation of the first roller moves relative to the main body of the housing. The method further includes the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position.

In a feature of this aspect, the housing comprises extension walls located proximate opposite exterior sides of the housing that extend above a top side of the housing, and the method further comprises a preliminary step of mounting the dispenser to the underside of a fixture, including removing a portion of each extension wall along a score line so as to adjust the distance from the underside of the fixture below which the top side of the housing is mounted. In some embodiments incorporating this feature, but not all such embodiments, the dispenser further comprises a motor assembly configured to cause a leading edge of the toweling to be extended from a housing of the dispenser and to cause the toweling to be subsequently retracted back into the housing, both of the steps of extending the toweling exterior of the housing for grasping by a user and the step of retracting the toweling into the housing being accomplished using the motor assembly; and the method further comprises the steps of sensing a leading edge of the toweling while retracting the toweling into the housing, and ceasing retracting of the toweling into the housing as a function of sensing the leading edge of the toweling. Also, In some embodiments incorporating this feature, but not all such embodiments, the loading door comprises a towel carrier having a curved surface defining a cavity within which toweling comprising a roll of paper towels is received and retained in floating engagement therewith, the roll of paper towels rolling and sliding on the curved surface when unwinding during said step of extending the toweling exterior of the housing for grasping by a user, and toweling gathering within the housing during retracting of the toweling into the housing and not being wound back onto the roll of paper towels.

In a feature of this aspect, the toweling comprises a roll of paper towels and the dispenser is configured to unwind roll of paper towels during extension of toweling from the housing but not rewind the roll of paper towels during subsequent retraction of toweling into the housing. Furthermore, a back side of the housing includes an opening that is configured such that excess toweling gathering within the housing may fall there through as a result of retraction of toweling back into the housing. In some embodiments incorporating this feature, but not all such embodiments, the dispenser further comprises a motor assembly configured to cause a leading edge of the toweling to be extended from a housing of the dispenser and to cause the toweling to be subsequently retracted back into the housing, both of the steps of extending the toweling exterior of the housing for grasping by a user and the step of retracting the toweling into the housing being accomplished using the motor assembly; and the method further comprises the steps of sensing a leading edge of the toweling while retracting the toweling into the housing, and ceasing retracting of the toweling into the housing as a function of sensing the leading edge of the toweling. Also, In some embodiments incorporating this feature, but not all such embodiments, the loading door comprises a towel carrier having a curved surface defining a cavity within which toweling comprising a roll of paper towels is received and retained in floating engagement therewith, the roll of paper towels rolling and sliding on the curved surface when unwinding during said step of extending the toweling exterior of the housing for grasping by a user, and toweling gathering within the housing during retracting of the toweling into the housing and not being wound back onto the roll of paper towels.

In another aspect, a towel dispenser comprises a housing for receiving toweling. The housing includes a main body, a loading door, and a guide system. The loading door is configured to rotate relative to the main body between a closed position, in which the housing is configured to dispense towels there from, and an open position, in which the housing is configured to receive toweling therein. The guide system is configured to guide the toweling within the housing while towels are dispensed from the housing. Furthermore, the guide system comprises a first roller attached to the main body and having a first toothed surface, and a second roller attached to the loading door and having a second toothed surface that is configured to mesh with the first toothed surface. The toothed surfaces of the first roller and the second roller mesh together when the loading door moves into the closed position from the open position and do not preclude the loading door from moving into the closed position from the open position. In a feature of this aspect, the housing further comprises extension walls located proximate opposite exterior sides of the housing that extends above a top side of the housing, each extension wall comprising a weakened line extending parallel to a weakened line of the other extension walls, whereby the extent above the top side at which each extension walls extends may be changed, the extent representing a distance from the underside of a fixture below which the top side of the housing is mounted when the towel dispenser is installed under the fixture. In some embodiments incorporating this feature, but not all such embodiments, the housing further comprises a motor assembly configured to cause a leading edge of the toweling to be extended from the housing and to cause the toweling to be retracted into the housing after the leading edge has been extended, and a sensor for sensing a leading edge of the toweling during retraction of the toweling by the motor assembly. The sensor is configured to cause the motor assembly to cease retracting the toweling into the housing as a function of the sensing of the leading edge of the toweling during retraction of the toweling into the housing. Also, In some embodiments incorporating this feature, but not all such embodiments, the loading door comprises a towel carrier having a curved surface defining a cavity configured to receive the roll of paper towels in floating engagement therewith such that the roll of paper towels rolls and slides on the curved surface during unwinding.

In another feature of this aspect, a back side of the housing includes an opening configured to permit excess toweling to fall during retraction of the toweling back into the housing. In some embodiments incorporating this feature, but not all such embodiments, the housing further comprises a motor assembly configured to cause a leading edge of the toweling to be extended from the housing and to cause the toweling to be retracted into the housing after the leading edge has been extended, and a sensor for sensing a leading edge of the toweling during retraction of the toweling by the motor assembly, wherein the sensor is configured to cause the motor assembly to cease retracting the toweling into the housing as a function of the sensing of the leading edge of the toweling during retraction of the toweling into the housing. In some embodiments incorporating this feature, but not all such embodiments, the loading door comprises a towel carrier having a curved surface defining a cavity configured to receive the roll of paper towels in floating engagement therewith such that the roll of paper towels rolls and slides on the curved surface during unwinding.

In a feature of this aspect, each toothed surfaces has a fairly large and forgiving tooth geometry.

In another feature, the first roller engages the second roller when the loading door is in the closed position.

In a feature, an axis of rotation of the first roller is located above and forward of an axis of rotation of the second roller when the loading door is in the closed position.

In a feature, the first roller extends generally alongside a compartment of the housing in which a battery is received, the compartment being accessible through a removable front cover of the housing for changing the battery.

In a feature, each toothed surface comprises an axially mounted end gear.

In a feature, the first toothed surfaces is located proximate a first end of the first roller, and wherein the second toothed surface is located proximate a first end of the second roller, the respective first ends of the first and second rollers being located proximate one another when the loading door is in the closed position.

In a feature, a transmission connects a motor to a second end of the first roller, the second end of the first roller being opposite to the first end of the first roller. In some various embodiments incorporating this feature, but not all such embodiments, the first end of the first roller is configured to move vertically a small extent, but the second end of the first roller is not configured to move vertically a small extent; the toothed surface of the first roller is spring biased into meshing engagement with the toothed surface of the second roller when the loading door moves into the closed position from the open position; and the second end of the first roller comprises a pivot point of the first roller. Also, in some embodiments incorporating this feature, but not all such embodiments, the first end of the first roller floats relative to the main body, but the second end of the first roller is fixed relative to the main body. In this respect, the toothed surface of the first roller may be spring biased into meshing engagement with the toothed surface of the second roller when the loading door moves into the closed position from the open position, and the second end of the first roller may comprise a pivot point of the first roller.

In a feature, a belt engages the second end of the first roller for driving of the first roller by the motor.

In a feature, the toothed surface of the first roller is spring biased into meshing engagement with the toothed surface of the second roller when the loading door moves into the closed position from the open position.

In still another feature, the only rollers of the guide system are the first and second rollers.

In another aspect of the invention, a towel dispenser comprises a housing for receiving toweling. The housing comprises a main body, a loading door, and a guide system. The loading door is configured to rotate relative to the main body between a closed position, in which the housing is configured to dispense towels there from, and an open position, in which the housing is configured to receive toweling therein. The guide system is configured to guide the toweling within the housing while towels are dispensed from the housing and comprises a first roller attached to the main body and having a toothed surface proximate a first end thereof, and a second roller attached to the loading door and having a toothed surface proximate a first end thereof that is configured to mesh with the toothed surface of the first roller. The housing further comprises a transmission that connects a motor to a second end of the first roller, the second end of the first roller being opposite the first end of the first roller.

In a feature of this aspect, the motor is located within the main body between the first roller and a front panel of the housing.

In a feature of this aspect, the housing further comprises a battery compartment and wherein the motor is battery powered, the battery compartment and motor being located within the main body between the first roller and a front panel of the housing.

In a feature of this aspect, the first end of the first roller is configured to move vertically by a small extent, but the second end of the first roller is not configured to move vertically by a small extent. In various embodiments incorporating this feature, but not all such embodiments, the toothed surface of the first roller is spring biased into meshing engagement with the toothed surface of the second roller when the loading door is in the closed position; and the second end of the first roller comprises a pivot point of the first roller.

In a feature of this aspect, the first end of the first roller floats relative to the main body, but the second end of the first roller is fixed relative to the main body.

In a feature of this aspect, the toothed surface of the first roller is spring biased into meshing engagement with the toothed surface of the second roller when the loading door moves into the closed position from the open position. In various embodiments incorporating this feature, but not all such embodiments, the second end of the first roller comprises a pivot point of the first roller.

In a feature of this aspect, a belt engages the first roller proximate a second end thereof for driving of the first roller by the motor.

In a feature of this aspect, the toothed surface of the first roller is spring biased into meshing engagement with the toothed surface of the second roller when the loading door is in the closed position.

In a feature of this aspect, the only rollers of the guide system are the first and second rollers.

In still another aspect, a towel dispenser includes a housing for receiving toweling. The housing comprises a main body, a loading door, and a guide system. The loading door that is configured to rotate relative to the main body between a closed position, in which the housing is configured to dispense towels there from, and an open position, in which the housing is configured to receive toweling therein. The guide system is configured to guide the toweling within the housing while towels are dispensed from the housing, and includes a first roller attached to the main body and having a first toothed surface, and a second roller attached to the loading door and having a second toothed surface that is configured to mesh with the first toothed surface. The first roller is spring biased toward engagement with the second roller when the loading door is in the closed position.

In a feature of this aspect, a transmission connects a motor to a second end of the first roller, the second end of the first roller being opposite to the first end of the first roller. In some embodiments incorporating this feature, but not all such embodiments, the first end of the first roller is configured to move vertically a small extent, but the second end of the first roller is not configured to move vertically a small extent. Additionally, in various ones of such embodiments, the second end of the first roller comprises a pivot point of the first roller; the first end of the first roller floats relative to the main body, but the second end of the first roller is fixed relative to the main body; and the second end of the first roller comprises a pivot point of the first roller.

In a feature of this aspect, a belt engages the second end of the first roller for driving of the first roller by the motor.

In another feature of this aspect, the only rollers of the guide system are the first and second rollers.

In yet another feature of this aspect, the second roller acts against the spring biasing of the first roller to displace at least one end of the first roller when the loading door is moved into the closed position.

In an aspect of the invention, a method of dispensing towels from toweling with a dispenser includes the steps of: extending the toweling exterior of a housing of the dispenser for grasping by a user; and subsequent thereto, retracting the toweling into the housing. The housing comprises extension walls located proximate opposite exterior sides of the housing that extend above a top side of the housing, and the method further comprises a preliminary step of mounting the dispenser to the underside of a fixture, including removing a portion of each extension wall along a score line so as to adjust the distance from the underside of the fixture below which the top side of the housing is mounted.

In a feature of this aspect, the toweling comprises a roll of paper towels and the dispenser is configured to unwind roll of paper towels during extension of toweling from the housing but not rewind the roll of paper towels during subsequent retraction of toweling into the housing, and a back side of the housing includes an opening that is configured such that excess toweling gathering within the housing may fall as a result of retraction of toweling back into the housing. In embodiments that incorporate this feature, but not all such embodiments, the method further comprises the steps of: using a motor assembly configured to cause a leading edge of the toweling to be extended from a housing of the dispenser and to cause the toweling to be subsequently retracted back into the housing in said steps of the method; sensing a leading edge of the toweling while retracting the toweling; and ceasing retracting of the toweling into the housing using the motor assembly as a function of sensing the leading edge of the toweling by the sensor. Also, in embodiments that incorporate this feature, but not all such embodiments, the housing comprises a main body, and a loading door that is configured to rotate relative to the main body between a closed position, in which the housing is configured to extend toweling there from, and an open position, in which the housing is configured to receive toweling therein. Furthermore, the loading door comprises a towel carrier having a curved surface defining a cavity within which toweling comprising a roll of paper towels is received and retained in floating engagement therewith such that the roll of paper towels rolls and slides on the curved surface when unwinding during said step of extending the toweling exterior of the housing for grasping by a user. The toweling further gathers within the housing during retracting of the toweling into the housing and is not wound back onto the roll of paper towels. Still yet in embodiments that incorporate this feature, but not all such embodiments, the housing comprises a main body, a loading door that is configured to rotate relative to the main body between a closed position, in which the housing is configured to extend toweling there from, and an open position, in which the housing is configured to receive toweling therein, and a guide system that is configured to guide the toweling within the housing during extension from and retraction into the housing of the toweling, the guide system comprising a first roller attached to the main body and having a first toothed surface, and a second roller attached to the loading door and having a second toothed surface that is configured to mesh with the first toothed surface. In this respect, at least one end of the first roller moves such that an axis of rotation of the first roller moves relative to the main body of the housing, and the method further comprises the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position.

In another feature, each extension wall is integral with the main body of the housing.

In a feature, each extension wall is integrally formed with the main body of the housing.

In a feature, each extension wall extends opposite side walls of the housing beyond the top side of the housing.

In a feature, each extension wall is configured to be broken off by hand upon bending along a weakened line of the extension wall.

In a feature, each extension wall includes a plurality of weakened lines.

In a feature, weakened line of an extension wall extends in parallel to, and at the same height from the top side of the housing, as a corresponding weakened line of the other extension wall.

In another aspect of the invention, a towel dispenser comprises a housing for receiving toweling comprising a roll of paper towels, the housing in turn comprising extension walls located proximate opposite exterior sides of the housing that extends above a top side of the housing, each extension wall comprising a weakened line extending parallel to a weakened line of the other extension walls, whereby the extent above the top side at which each extension walls extends may be changed, the extent representing a distance from the underside of a fixture below which the top side of the housing is mounted when the towel dispenser is installed under the fixture.

In a feature of this aspect, a back side of the housing includes an opening configured to permit excess toweling to fall there through during retraction of the toweling into the housing. In some embodiments incorporating this feature, but not all such embodiments, the housing further comprises a motor assembly configured to cause a leading edge of the toweling to be extended from the housing and to cause the toweling to be retracted into the housing after the leading edge has been extended; and a sensor for sensing a leading edge of the toweling during retraction of the toweling by the motor assembly. The sensor is configured to cause the motor assembly to cease retracting the toweling into the housing as a function of the sensing of the leading edge of the toweling during retraction of the toweling into the housing. Also, in some embodiments incorporating this feature, but not all such embodiments, the housing comprises a main body and a loading door that is configured to rotate relative to the main body between a closed position, in which the housing is configured to extend toweling there from, and an open position, in which the housing is configured to receive toweling therein. The loading door comprises a towel carrier having a curved surface defining a cavity configured to receive the roll of paper towels in floating engagement therewith such that the roll of paper towels rolls and slides on the curved surface during unwinding.

In another feature of this aspect, the towel dispenser includes a housing that, in turn, comprises a main body, a loading door, and a guide system. The loading door is configured to rotate relative to the main body between a closed position, in which the housing is configured to extend toweling there from, and an open position, in which the housing is configured to receive toweling therein. The guide system is configured to guide the toweling within the housing during extension from and retraction into the housing of the toweling, the guide system comprising a first roller attached to the main body and having a first toothed surface, and a second roller attached to the loading door and having a second toothed surface that is configured to mesh with the first toothed surface. At least one end of the first roller moves such that an axis of rotation of the first roller moves relative to the main body of the housing, the first roller is spring biased toward engagement with the second roller when the loading door is in the closed position, and the toothed surfaces of the first roller and the second roller mesh together when the loading door moves into the closed position from the open position and do not preclude the loading door from moving into the closed position from the open position.

In another aspect, a method of dispensing towels from toweling with a dispenser includes the steps of: extending the toweling exterior of a housing of the dispenser for grasping by a user; and subsequent thereto, retracting the toweling into the housing. The toweling comprises a roll of paper towels and the dispenser is configured to unwind roll of paper towels during extension of toweling from the housing but not rewind the roll of paper towels during subsequent retraction of toweling into the housing, and a back side of the housing includes an opening that is configured such that excess toweling gathering within the housing may fall as a result of retraction of toweling back into the housing.

In a feature of this aspect, the method further includes the steps of: using a motor assembly configured to cause a leading edge of the toweling to be extended from a housing of the dispenser and to cause the toweling to be subsequently retracted back into the housing, performing said steps of extending the toweling exterior of the housing for grasping by a user and subsequent thereto, retracting the toweling into the housing; and, using a sensor for sensing a leading edge of the toweling, sensing a leading edge of the toweling while retracting the toweling; ceasing retracting of the toweling into the housing using the motor assembly as a function of sensing the leading edge of the toweling by the sensor. Further in this respect, the housing comprises a main body, a loading door, and a guide system. The loading door is configured to rotate relative to the main body between a closed position, in which the housing is configured to extend toweling there from, and an open position, in which the housing is configured to receive toweling therein. The guide system is configured to guide the toweling within the housing during extension from and retraction into the housing of the toweling, the guide system comprising a first roller attached to the main body and having a first toothed surface, and a second roller attached to the loading door and having a second toothed surface that is configured to mesh with the first toothed surface, at least one end of the first roller being configured to move such that an axis of rotation of the first roller moves relative to the main body of the housing. The loading door further comprises a towel carrier having a curved surface defining a cavity within which toweling comprising a roll of paper towels is received and retained in floating engagement therewith, the roll of paper towels rolling and sliding on the curved surface when unwinding during said step of extending the toweling exterior of the housing for grasping by a user, and toweling gathering within the housing during retracting of the toweling into the housing and not being wound back onto the roll of paper towels. Additionally, the method further comprises the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position.

In a feature of this aspect, the method further comprises the steps of: using a motor assembly configured to cause a leading edge of the toweling to be extended from a housing of the dispenser and to cause the toweling to be subsequently retracted back into the housing, performing said steps of extending the toweling exterior of the housing for grasping by a user and subsequent thereto, retracting the toweling into the housing; using a sensor for sensing a leading edge of the toweling, sensing a leading edge of the toweling while retracting the toweling; and ceasing retracting of the toweling into the housing using the motor assembly as a function of sensing the leading edge of the toweling by the sensor. Further in this respect, the housing comprises a main body, a loading door, and a guide system. The loading door is configured to rotate relative to the main body between a closed position, in which the housing is configured to extend toweling there from, and an open position, in which the housing is configured to receive toweling therein. The loading door further comprises a towel carrier having a curved surface defining a cavity within which toweling comprising a roll of paper towels is received and retained in floating engagement therewith, the roll of paper towels rolling and sliding on the curved surface when unwinding during said step of extending the toweling exterior of the housing for grasping by a user, and toweling gathering within the housing during retracting of the toweling into the housing and not being wound back onto the roll of paper towels. The housing comprises extension walls located proximate opposite exterior sides of the housing that extend above a top side of the housing, and wherein the method further comprises a preliminary step of mounting the dispenser to the underside of a fixture, including removing a portion of each extension wall along a score line so as to adjust the distance from the underside of the fixture below which the top side of the housing is mounted.

In a feature of this aspect, the housing comprises a main body and a loading door that is configured to rotate relative to the main body between a closed position, in which the housing is configured to extend toweling there from, and an open position, in which the housing is configured to receive toweling therein. The housing also comprise a guide system that is configured to guide the toweling within the housing during extension from and retraction into the housing of the toweling, the guide system comprising a first roller attached to the main body and having a first toothed surface, and a second roller attached to the loading door and having a second toothed surface that is configured to mesh with the first toothed surface, at least one end of the first roller being configured to move such that an axis of rotation of the first roller moves relative to the main body of the housing. Further in this respect, the loading door comprises a towel carrier having a curved surface defining a cavity within which toweling comprising a roll of paper towels is received and retained in floating engagement therewith, the roll of paper towels rolling and sliding on the curved surface when unwinding during said step of extending the toweling exterior of the housing for grasping by a user, and toweling gathering within the housing during retracting of the toweling into the housing and not being wound back onto the roll of paper towels; the method further comprises the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position; and wherein the housing comprises extension walls located proximate opposite exterior sides of the housing that extend above a top side of the housing, and wherein the method further comprises a preliminary step of mounting the dispenser to the underside of a fixture, including removing a portion of each extension wall along a score line so as to adjust the distance from the underside of the fixture below which the top side of the housing is mounted.

In a feature of this aspect, the method further comprises the steps of: using a motor assembly configured to cause a leading edge of the toweling to be extended from a housing of the dispenser and to cause the toweling to be subsequently retracted back into the housing, performing said steps of extending the toweling exterior of the housing for grasping by a user and subsequent thereto, retracting the toweling into the housing; using a sensor for sensing a leading edge of the toweling, sensing a leading edge of the toweling while retracting the toweling; and ceasing retracting of the toweling into the housing using the motor assembly as a function of sensing the leading edge of the toweling by the sensor. The housing comprises a main body, a loading door, and a guide system. The loading door is configured to rotate relative to the main body between a closed position, in which the housing is configured to extend toweling there from, and an open position, in which the housing is configured to receive toweling therein. The guide system is configured to guide the toweling within the housing during extension from and retraction into the housing of the toweling, the guide system comprising a first roller attached to the main body and having a first toothed surface, and a second roller attached to the loading door and having a second toothed surface that is configured to mesh with the first toothed surface, at least one end of the first roller being configured to move such that an axis of rotation of the first roller moves relative to the main body of the housing. Further in this respect, the method further comprises the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position; and the housing comprises extension walls located proximate opposite exterior sides of the housing that extend above a top side of the housing, and wherein the method further comprises a preliminary step of mounting the dispenser to the underside of a fixture, including removing a portion of each extension wall along a score line so as to adjust the distance from the underside of the fixture below which the top side of the housing is mounted.

In yet another feature of this aspect, the method further comprises the steps of: using a motor assembly configured to cause a leading edge of the toweling to be extended from a housing of the dispenser and to cause the toweling to be subsequently retracted back into the housing, performing said steps of extending the toweling exterior of the housing for grasping by a user and subsequent thereto, retracting the toweling into the housing; using a sensor for sensing a leading edge of the toweling, sensing a leading edge of the toweling while retracting the toweling; and ceasing retracting of the toweling into the housing using the motor assembly as a function of sensing the leading edge of the toweling by the sensor. Further in this respect, the housing comprises a main body, a loading door, and a guide system. The loading door is configured to rotate relative to the main body between a closed position, in which the housing is configured to extend toweling there from, and an open position, in which the housing is configured to receive toweling therein. The guide system is configured to guide the toweling within the housing during extension from and retraction into the housing of the toweling, the guide system comprising a first roller attached to the main body and having a first toothed surface, and a second roller attached to the loading door and having a second toothed surface that is configured to mesh with the first toothed surface, at least one end of the first roller being configured to move such that an axis of rotation of the first roller moves relative to the main body of the housing. The loading door comprises a towel carrier having a curved surface defining a cavity within which toweling comprising a roll of paper towels is received and retained in floating engagement therewith, the roll of paper towels rolling and sliding on the curved surface when unwinding during said step of extending the toweling exterior of the housing for grasping by a user, and toweling gathering within the housing during retracting of the toweling into the housing and not being wound back onto the roll of paper towels. Furthermore, the method additionally comprises the step of moving the loading door into the closed position after loading toweling within the dispenser, with the first roller being urged into engagement with the second roller when the loading door enters the closed position and the second roller acting on the first roller so as to displace at least one end of the first roller when the loading door enters the closed position. The housing also further comprises extension walls located proximate opposite exterior sides of the housing that extend above a top side of the housing, and wherein the method further comprises a preliminary step of mounting the dispenser to the underside of a fixture, including removing a portion of each extension wall along a score line so as to adjust the distance from the underside of the fixture below which the top side of the housing is mounted.

In still yet another aspect of the invention, a towel dispenser comprises a housing for receiving toweling. The housing in turn comprises a main body, a loading door, a guide system, and a motor assembly. The loading door is configured to rotate relative to the main body between a closed position, in which the housing is configured to dispense towels there from, and an open position, in which the housing is configured to receive toweling therein. The guide system is configured to guide the toweling within the housing while towels are dispensed from the housing. The motor assembly is configured to cause a leading edge of the toweling to be extended from the housing and to cause the toweling to be retracted into the housing after the leading edge has been extended. Furthermore, a back side of the housing includes an opening configured to permit excess toweling to fall there through during retraction of the toweling back into the housing by the motor assembly.

In a feature of this aspect, the towel dispenser further comprises a sensor for sensing a leading edge of the toweling during retraction of the toweling by the motor assembly. The sensor is configured to cause the motor assembly to cease retracting the toweling into the housing as a function of the sensing of the leading edge of the toweling during retraction of the toweling into the housing. Additionally, the guide system comprises a first roller attached to the main body and having a first toothed surface, and a second roller attached to the loading door and having a second toothed surface that is configured to mesh with the first toothed surface; the loading door comprises a towel carrier having a curved surface defining a cavity configured to receive the roll of paper towels in floating engagement therewith such that the roll of paper towels rolls and slides on the curved surface during unwinding; at least one end of the first roller moves such that an axis of rotation of the first roller moves relative to the main body of the housing; the first roller is spring biased toward engagement with the second roller when the loading door is in the closed position; and the toothed surfaces of the first roller and the second roller mesh together when the loading door moves into the closed position from the open position and do not preclude the loading door from moving into the closed position from the open position.

In a feature of this aspect, the towel dispenser further comprises a sensor for sensing a leading edge of the toweling during retraction of the toweling by the motor assembly. The sensor is configured to cause the motor assembly to cease retracting the toweling into the housing as a function of the sensing of the leading edge of the toweling during retraction of the toweling into the housing. Moreover, the loading door comprises a towel carrier having a curved surface defining a cavity configured to receive the roll of paper towels in floating engagement therewith such that the roll of paper towels rolls and slides on the curved surface during unwinding; and the housing further comprises extension walls located proximate opposite exterior sides of the housing that extends above a top side of the housing, each extension wall comprising a weakened line extending parallel to a weakened line of the other extension walls, whereby the extent above the top side at which each extension walls extends may be changed, the extent representing a distance from the underside of a fixture below which the top side of the housing is mounted when the towel dispenser is installed under the fixture.

In still another feature of this aspect, the guide system comprises a first roller attached to the main body and having a first toothed surface, and a second roller attached to the loading door and having a second toothed surface that is configured to mesh with the first toothed surface; the loading door comprises a towel carrier having a curved surface defining a cavity configured to receive the roll of paper towels in floating engagement therewith such that the roll of paper towels rolls and slides on the curved surface during unwinding; at least one end of the first roller moves such that an axis of rotation of the first roller moves relative to the main body of the housing; the first roller is spring biased toward engagement with the second roller when the loading door is in the closed position; the toothed surfaces of the first roller and the second roller mesh together when the loading door moves into the closed position from the open position and do not preclude the loading door from moving into the closed position from the open position; and the housing further comprises extension walls located proximate opposite exterior sides of the housing that extends above a top side of the housing, each extension wall comprising a weakened line extending parallel to a weakened line of the other extension walls, whereby the extent above the top side at which each extension walls extends may be changed, the extent representing a distance from the underside of a fixture below which the top side of the housing is mounted when the towel dispenser is installed under the fixture.

In a feature of this aspect, the towel dispenser further comprises a sensor for sensing a leading edge of the toweling during retraction of the toweling by the motor assembly. The sensor is configured to cause the motor assembly to cease retracting the toweling into the housing as a function of the sensing of the leading edge of the toweling during retraction of the toweling into the housing. Moreover, the guide system comprises a first roller attached to the main body and having a first toothed surface, and a second roller attached to the loading door and having a second toothed surface that is configured to mesh with the first toothed surface; at least one end of the first roller moves such that an axis of rotation of the first roller moves relative to the main body of the housing; the first roller is spring biased toward engagement with the second roller when the loading door is in the closed position; and the toothed surfaces of the first roller and the second roller mesh together when the loading door moves into the closed position from the open position and do not preclude the loading door from moving into the closed position from the open position. Furthermore, the housing further comprises extension walls located proximate opposite exterior sides of the housing that extends above a top side of the housing, each extension wall comprising a weakened line extending parallel to a weakened line of the other extension walls, whereby the extent above the top side at which each extension walls extends may be changed, the extent representing a distance from the underside of a fixture below which the top side of the housing is mounted when the towel dispenser is installed under the fixture.

In a feature of this aspect, the towel dispenser further comprises a sensor for sensing a leading edge of the toweling during retraction of the toweling by the motor assembly. The sensor is configured to cause the motor assembly to cease retracting the toweling into the housing as a function of the sensing of the leading edge of the toweling during retraction of the toweling into the housing. Moreover, the guide system comprises a first roller attached to the main body and having a first toothed surface, and a second roller attached to the loading door and having a second toothed surface that is configured to mesh with the first toothed surface; the loading door comprises a towel carrier having a curved surface defining a cavity configured to receive the roll of paper towels in floating engagement therewith such that the roll of paper towels rolls and slides on the curved surface during unwinding; at least one end of the first roller moves such that an axis of rotation of the first roller moves relative to the main body of the housing; the first roller is spring biased toward engagement with the second roller when the loading door is in the closed position; the toothed surfaces of the first roller and the second roller mesh together when the loading door moves into the closed position from the open position and do not preclude the loading door from moving into the closed position from the open position; and the housing further comprises extension walls located proximate opposite exterior sides of the housing that extends above a top side of the housing, each extension wall comprising a weakened line extending parallel to a weakened line of the other extension walls, whereby the extent above the top side at which each extension walls extends may be changed, the extent representing a distance from the underside of a fixture below which the top side of the housing is mounted when the towel dispenser is installed under the fixture.

In another aspect of the invention, a towel dispenser comprises: a housing for receiving toweling, wherein the toweling includes towels that are connected together and separable at perforation fonned between the towels; a motor configured to selectively cause a leading edge of the toweling to be extended from the housing and to cause the toweling to be retracted into the housing; and a sensor for sensing a leading edge of the toweling. The sensor is configured to cause the motor to cease retracting toweling into the housing in response to the sensing of the leading edge of the toweling.

In still yet another aspect of the invention, a method of dispensing towels from a dispenser includes the steps of: providing (i) a towel dispenser including a housing for containing toweling, wherein the toweling includes towels connected together and separable at perforations formed there between, (ii) a motor configured to selectively cause a leading edge of the toweling to be extended from the housing and to cause the toweling to be retracted into the housing, and (iii) a sensor for sensing a leading edge of the toweling; using the motor, extending the toweling exterior of the housing for grasping by a user; using the motor, retracting the toweling into the housing; while retracting the toweling, sensing a leading edge of the toweling using the sensor; and ceasing to retract the toweling into the housing using the motor upon sensing the leading edge of the toweling by the sensor. Other aspects of the invention relate to structure of towel dispensers as disclosed herein.

In another aspect of the invention, a method includes advancing toweling using a motor of a paper towel dispenser apparatus; determining, via a sensor, when a certain extent of toweling has been advanced; based on said determining when a certain extent of toweling has been advanced, ceasing the advance of the advancing toweling, wherein, upon ceasing the advance of the advancing toweling, a first length of toweling is extended outside of a housing of the paper towel dispenser apparatus; determining, via the sensor, that the length of toweling extended outside of the housing has increased, wherein a second length of toweling is extended outside of the housing of the paper towel dispenser apparatus, the second length being greater than the first length; and in response to said determining that the length of toweling extended outside of the housing has increased, applying force to the toweling, via the motor, in a manner adapted to retract the toweling such that the length of toweling extended outside of the housing decreases.

In a feature of this aspect, said step of applying force to the toweling, via the motor, in a manner adapted to retract the toweling such that the length of toweling extended outside of the housing decreases comprises applying force to the toweling, via the motor, in a manner adapted to retract the toweling such that the length of toweling extended outside of the housing is once again the first length.

In a feature of this aspect, said step of advancing toweling comprises providing current of a first polarity to the motor; said step of ceasing the advance of the advancing toweling comprises drawing current out of the motor; and said step of applying force to the toweling, via the motor, comprises providing current of a second polarity to the motor, the second polarity being reverse of the first polarity.

In a feature of this aspect, the sensor comprises a slot sensor.

In another aspect of the invention, a method includes, when a length of toweling is extended outside of a housing of a paper towel dispenser, determining, via a sensor, that the length of toweling extended outside of the housing of the paper towel dispenser has increased; and in response to said determining that the length of toweling extended outside of the housing has increased, applying force to the toweling, via the motor, in a manner adapted to retract the toweling such that the length of toweling extended outside of the housing decreases.

In a feature of this aspect, said step of applying force to the toweling, via the motor, in a manner adapted to retract the toweling such that the length of toweling extended outside of the housing decreases comprises applying force to the toweling, via the motor, in a manner adapted to retract the toweling such that the length of toweling extended outside of the housing is once again the first length.

In a feature of this aspect, the sensor comprises a slot sensor.

In another aspect of the invention, a method includes advancing toweling using a motor of a paper towel dispenser apparatus; monitoring, via a sensor, rotation that occurs as toweling is advanced or retracted; determining, via the sensor, that a certain amount of rotation has occurred; based on said determining that a certain amount of rotation has occurred, ceasing the advance of the advancing toweling; after said ceasing of the advance of the advancing toweling, determining, via the sensor, that additional rotation has occurred; and in response to said determining that a certain amount of rotation has occurred, applying force, via the motor, in a manner adapted to counteract the additional rotation.

In a feature of this aspect, said step of applying force, via the motor, in a manner adapted to counteract the additional rotation comprises effecting rotation in a direction opposite the direction of the additional rotation.

In a feature of this aspect, said step of advancing toweling comprises providing current of a first polarity to the motor; said step of ceasing the advance of the advancing toweling comprises drawing current out of the motor; and said step of applying force to the toweling, via the motor, comprises providing current of a second polarity to the motor, the second polarity being reverse of the first polarity.

In a feature of this aspect, the sensor comprises a slot sensor.

Still other aspects of the invention relate to methods and operational logic of towel dispensers as disclosed herein.

Still yet other aspects and features may be found in the incorporated patent publication.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention are represented in the drawings, wherein:

FIG. 18 is a left side elevation view of part of the automatic paper towel dispenser apparatus of FIG. 16.

FIG. 19 is a right side elevation view of part of the automatic paper towel dispenser apparatus of FIG. 16.

DETAILED DESCRIPTION

Figure 1:
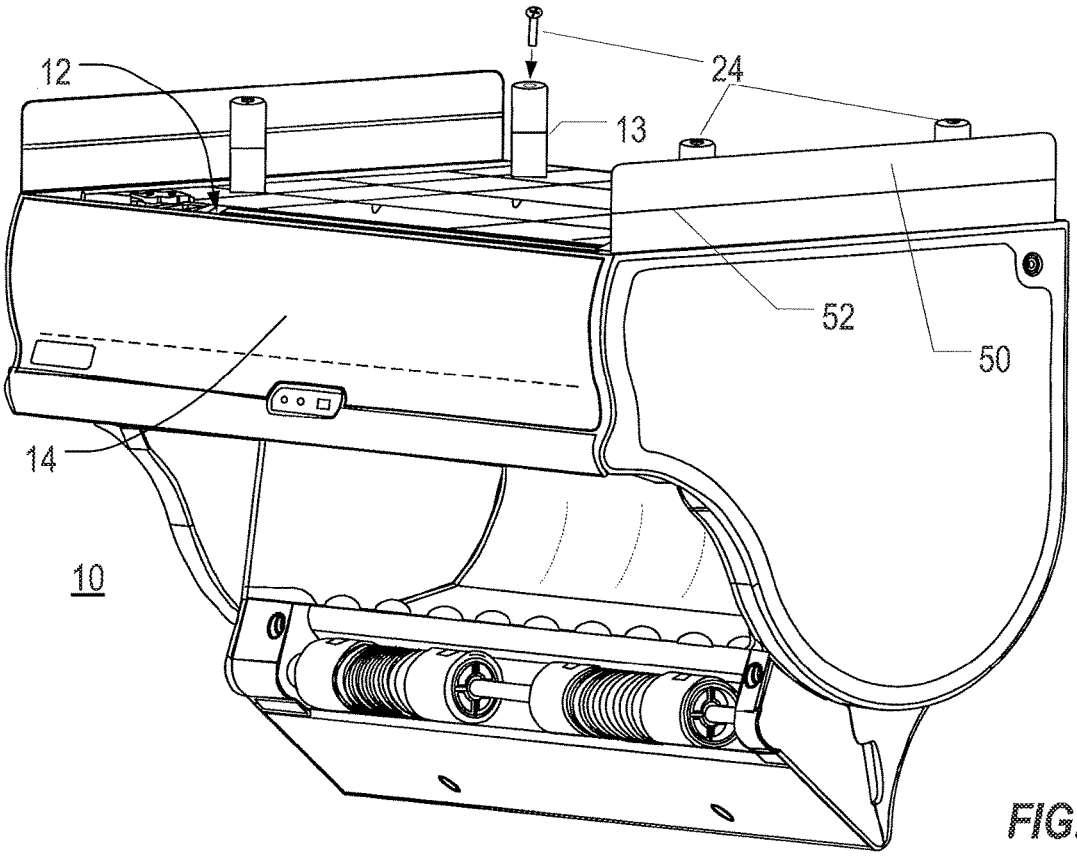
FIG. 1 is perspective view of part of an automatic paper towel dispenser apparatus in accordance with an embodiment of the invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the full scope of the present invention that is contemplated. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, embodiments of the present invention are next described. The following description of the embodiments is merely exemplary in nature and is in no way intended to limit the invention, its implementations, or uses.

Turning now to the drawings, FIG. 1 illustrates a perspective view of an automatic paper towel dispenser apparatus 10 in accordance with one embodiment of the present invention. The apparatus 10 dispenses common, readily available, perforated paper towels. Furthermore, the apparatus has a learning capability, giving it the ability to detect and dispense towels of varying lengths, including full sheets, half sheets, multiple sheets, and abnormally sized sheets. Therefore, a wide variety of perforated towels can be used with the apparatus, including any brand or length available at retail.

Figure 2:
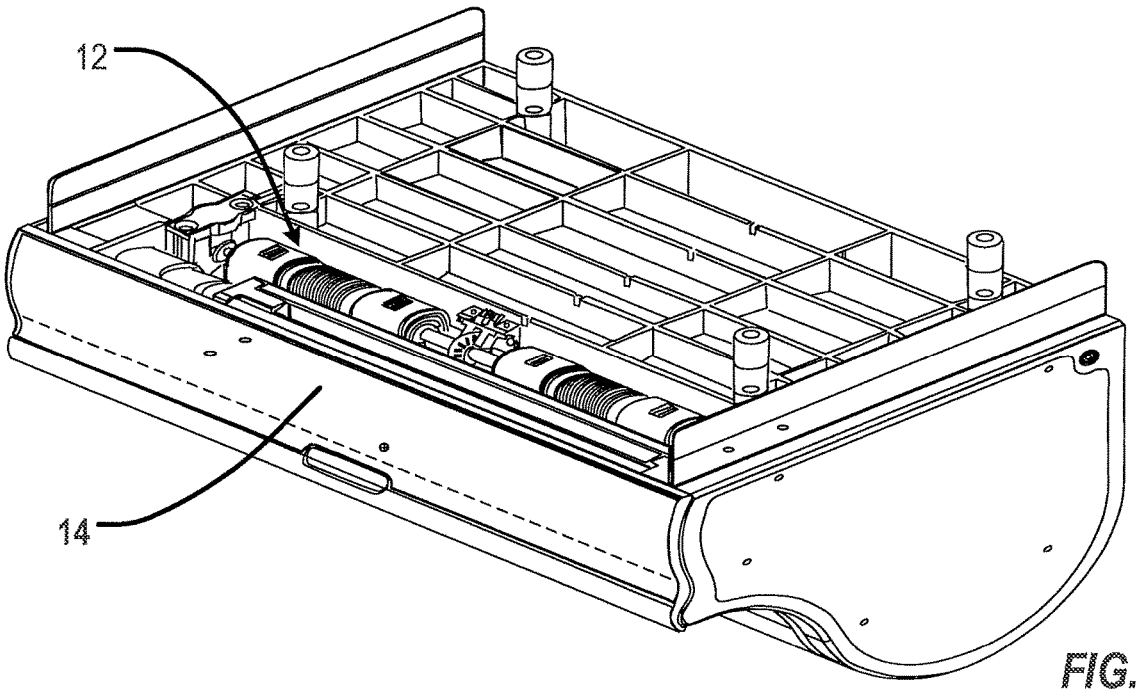
FIG. 2 is an isometric view of part of the automatic paper towel dispenser apparatus of FIG. 1 illustrating a top drive mechanism.
Figure 3:
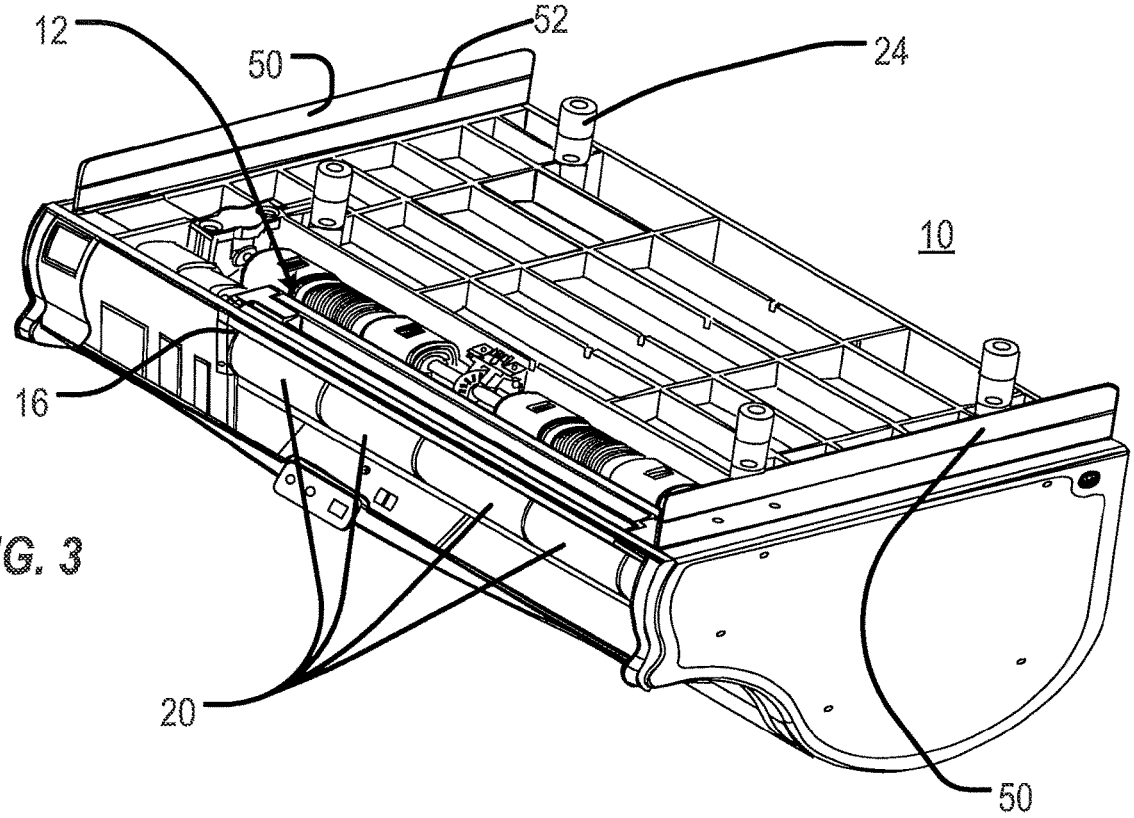
FIG. 3 is a perspective view of part of the automatic paper towel dispenser apparatus of FIG. 1, with the front cover removed to show the battery holder and control circuitry.
Figure 4:
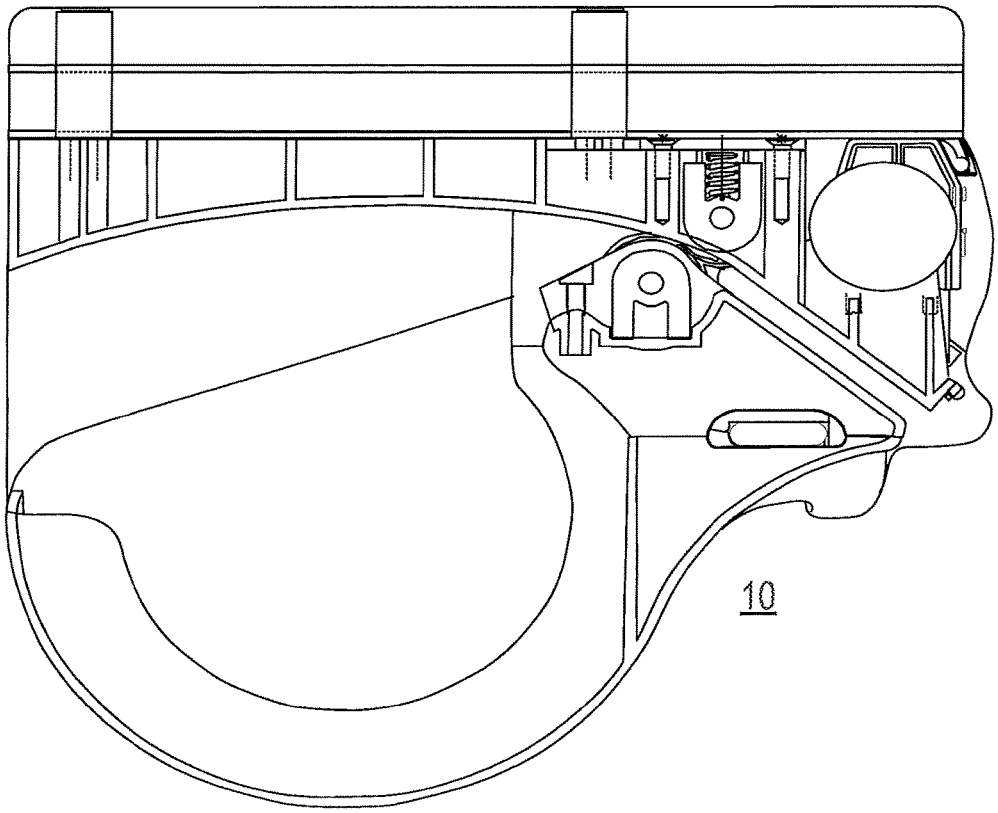
FIG. 4 is a cross-sectional view of part of the automatic paper towel dispenser apparatus of FIG. 1, showing the spring mechanism that allows an end of the top driven roller to move vertically, which compensates for both paper thickness variations and manufacturing tolerances.
Figure 5:
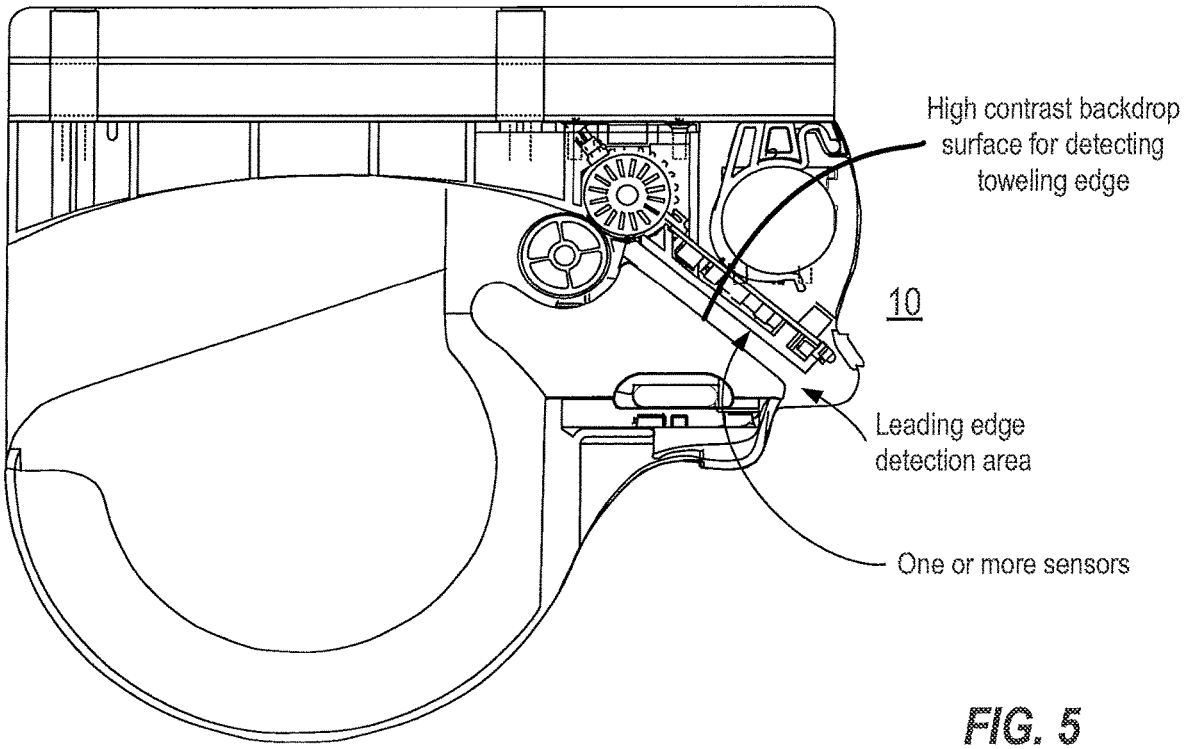
FIG. 5 is a cross-sectional view of part of the automatic paper towel dispenser apparatus of FIG. 1, through the center of the device, showing the drive roller orientation, slotted encoder wheel for measuring toweling length, and loading door including a lower material guide in the closed position.
Figure 6:
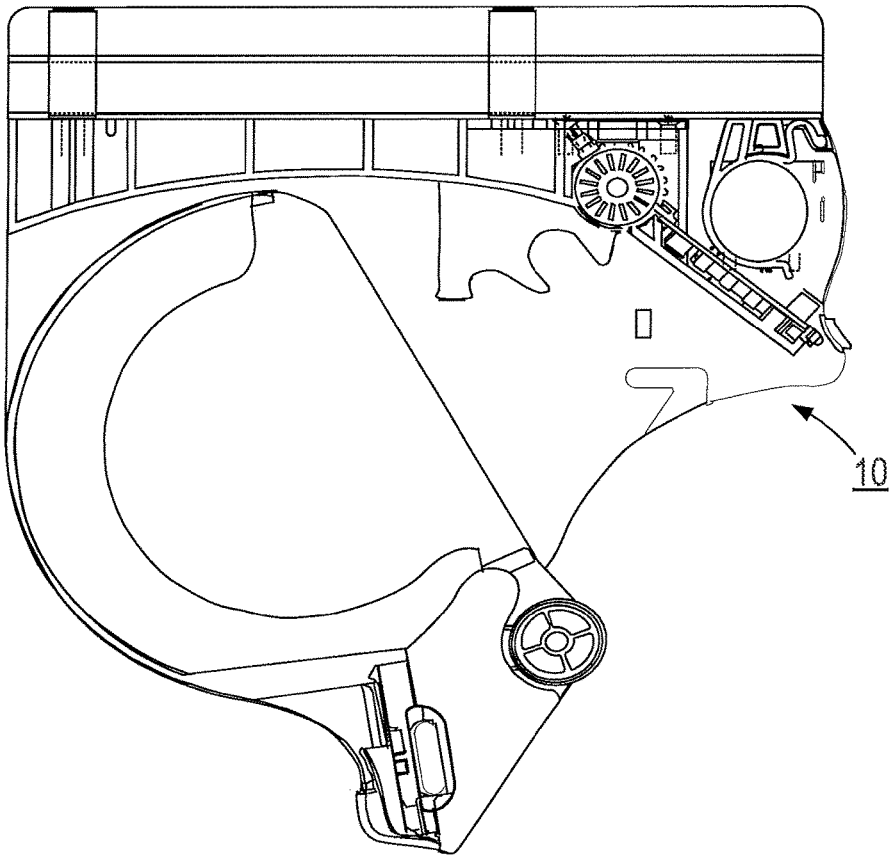
FIG. 6 is another cross-sectional view of part of the automatic paper towel dispenser apparatus of FIG. 1, through the center of the device, showing the drive roller orientation, slotted encoder wheel, and loading door in the open position.
Figure 13:
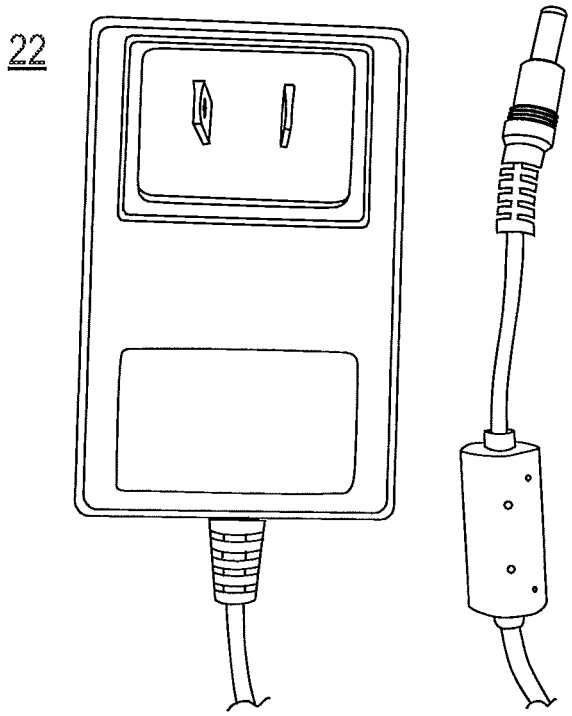
FIG. 13 is an illustration of the 6V, 3.5 A, AC/DC power supply used with an embodiment of the invention.

FIG. 2 is an isometric view of the apparatus 10 and FIG. 3 is a perspective view of the apparatus 10. FIG. 2 shows the top drive mechanism 12 of the towel dispenser apparatus 10. FIG. 3 shows the apparatus with the front cover 14 removed, displaying the battery holder 16 and control circuitry 18. Preferably, the apparatus 10 may be powered by either batteries 20 (as shown in FIG. 3) or an AC/DC adapter 22 (such as the one illustrated in FIG. 13).

The apparatus 10 is intended to be mounted under kitchen cabinetry, or on the underside of any sufficiently sized shelf. Four screws 24 interface with thread inserts in the main structure of the dispenser 10. Installation involves drilling four holes, positioned with a supplied template. Some features have been included to allow a level of installation customization. Kitchen cabinets are constructed in a number of ways. If a recess exists under a cabinet, the dispenser can be mounted with the supplied spacers 13. These spacers slide onto the screws. They can be stacked and combined to achieve three height offsets for the dispenser.

Furthermore, if spacers are used, a gap between the dispenser and underside of the cabinet may be visible from some angles. To address this aesthetic issue, trim tabs 50 have been designed into the exterior side covers of the apparatus 10. These trim tabs 50 are simply molded with the side covers, and can be folded over or snapped off at scores 52 (or otherwise bent) as desired in order to accommodate spacing between the top panel of the apparatus and the bottom of the underside of the cabinet.

As an alternative to the spacers, it is contemplated that a bracket may be used for mounting the dispenser.

Figure 12:
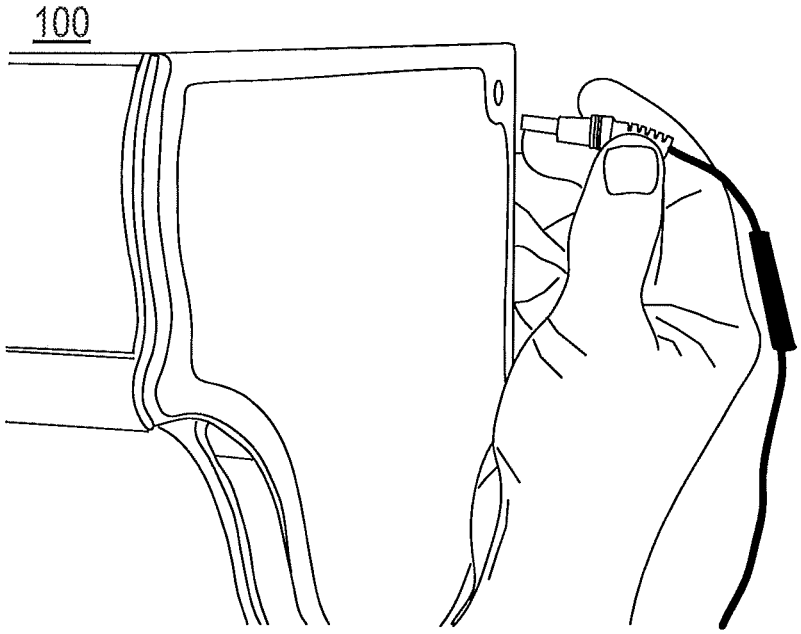
FIG. 12 is a partial perspective view of an automatic paper towel dispenser apparatus in accordance with an embodiment of the invention, in which is shown the connection of an optional 6V DC power supply for powering the internal motor of the automatic paper towel dispenser apparatus.

Use of the device begins by deciding on the source of power. Four D batteries 20 can be used to supply the necessary 6V input, or a 6V, 3.5 A AC/DC adapter 22 can be connected via a standard 5 mm input jack, as illustrated in FIG. 12. If the AC/DC adapter 22 is selected, power from the batteries 20 is interrupted, protecting the circuitry 18 from over voltage damage. Specifically, plugging in the connector of the adapter into the housing of the dispenser apparatus 100 breaks the battery circuit, thereby preventing parallel connection of the batteries and AC/DC supply. An off the shelf DC jack with a ground interrupt loop, KOBICONN 163-MJ21-EX, provides this switching protection.

Figure 7:
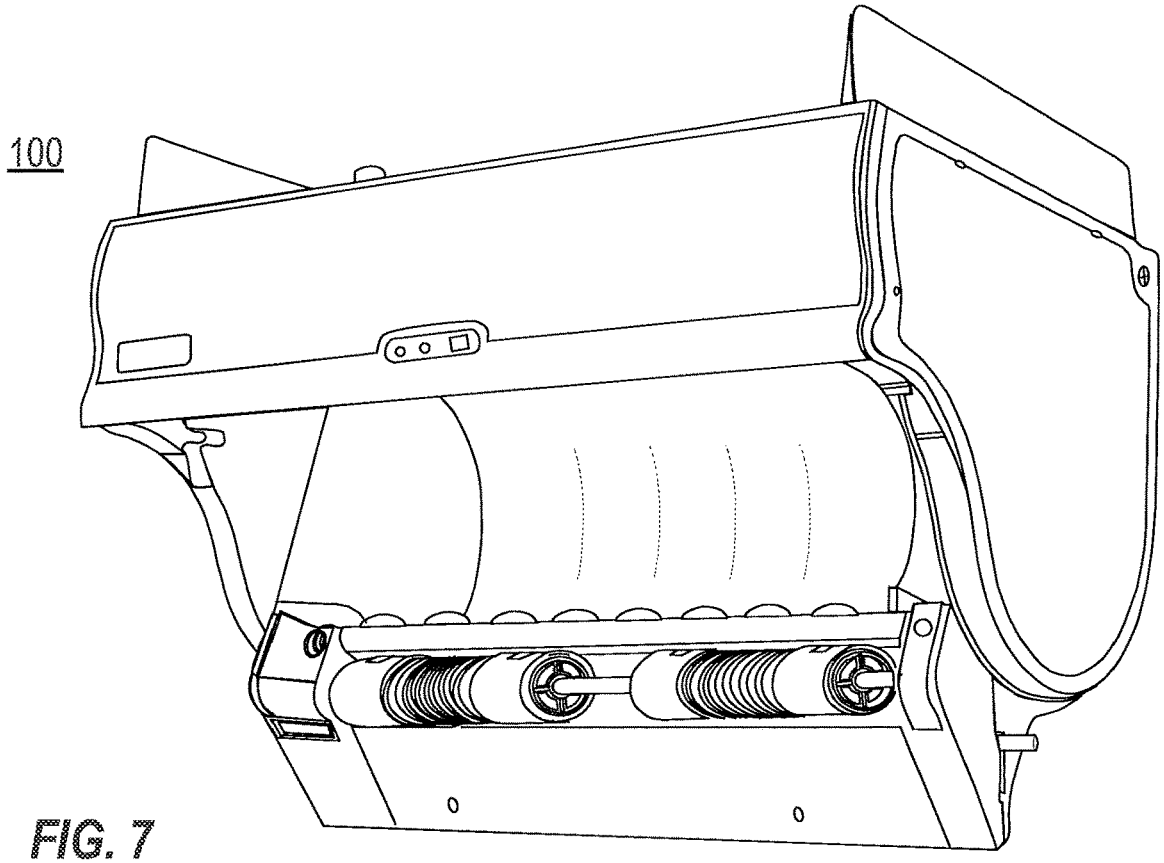
FIG. 7 is a perspective view of part of an automatic paper towel dispenser apparatus in accordance with an embodiment of the invention, in which the loading door open is open and the dispenser apparatus is ready to receive a roll of paper towels.
Figure 8:
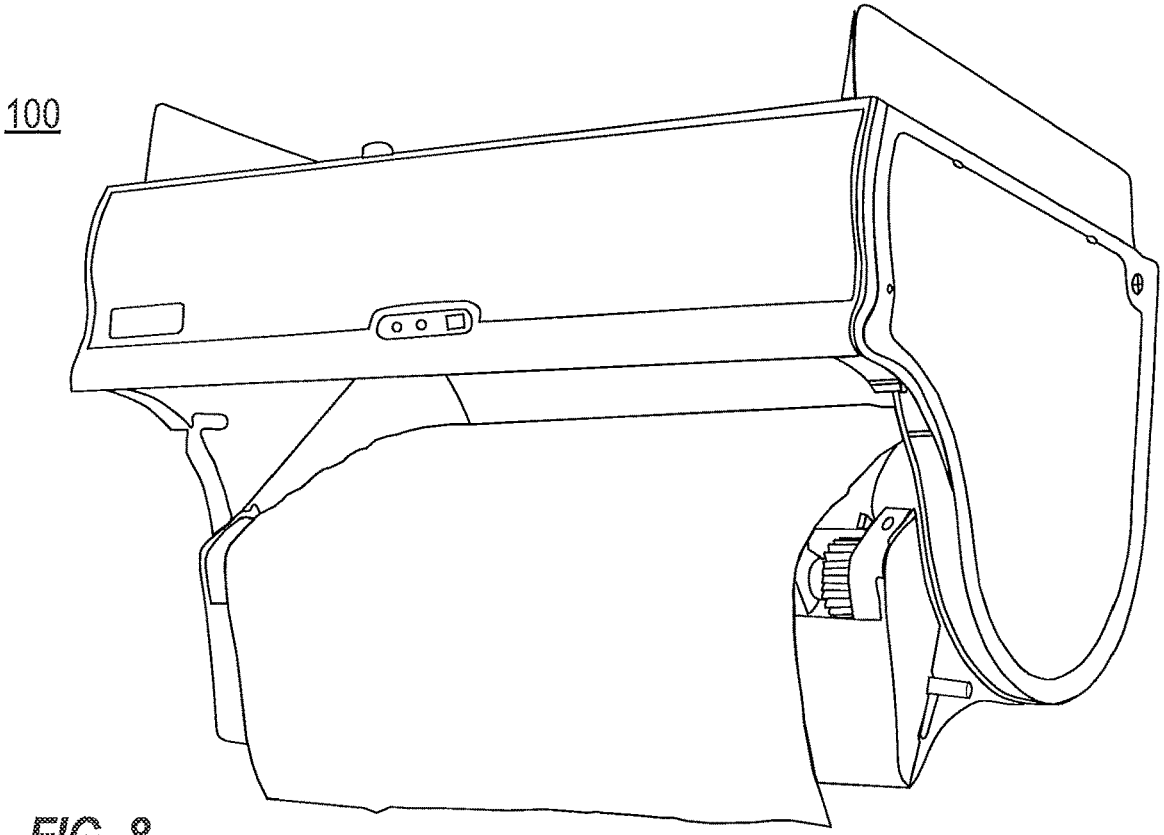
FIG. 8 is a perspective view of part of an automatic paper towel dispenser apparatus of FIG. 7, in which a roll of paper towels has been placed in the loading door, with a section of the toweling removed from the roll and draped over the roller of the loading door whereby an IR sensor at the front lip of the device can detect the toweling.
Figure 9:
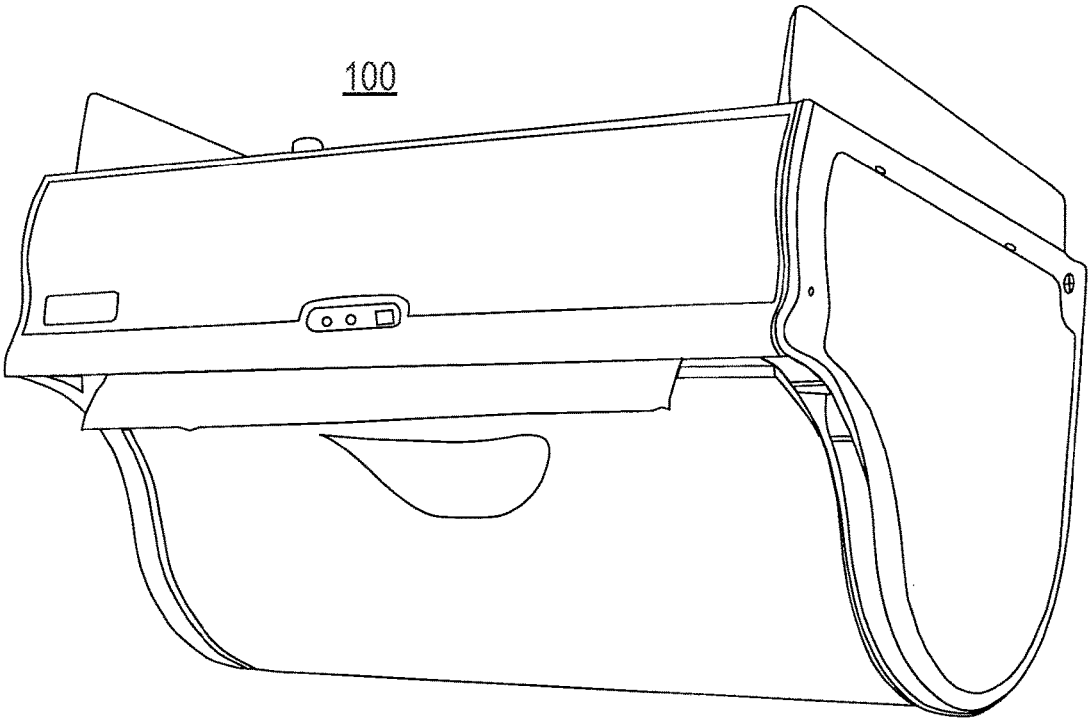
FIG. 9 is a perspective view of part of an automatic paper towel dispenser apparatus of FIG. 8, wherein the loading door has been closed with a length of the toweling extending from the housing, whereupon the length learn sequence is initiated.
Figure 10:
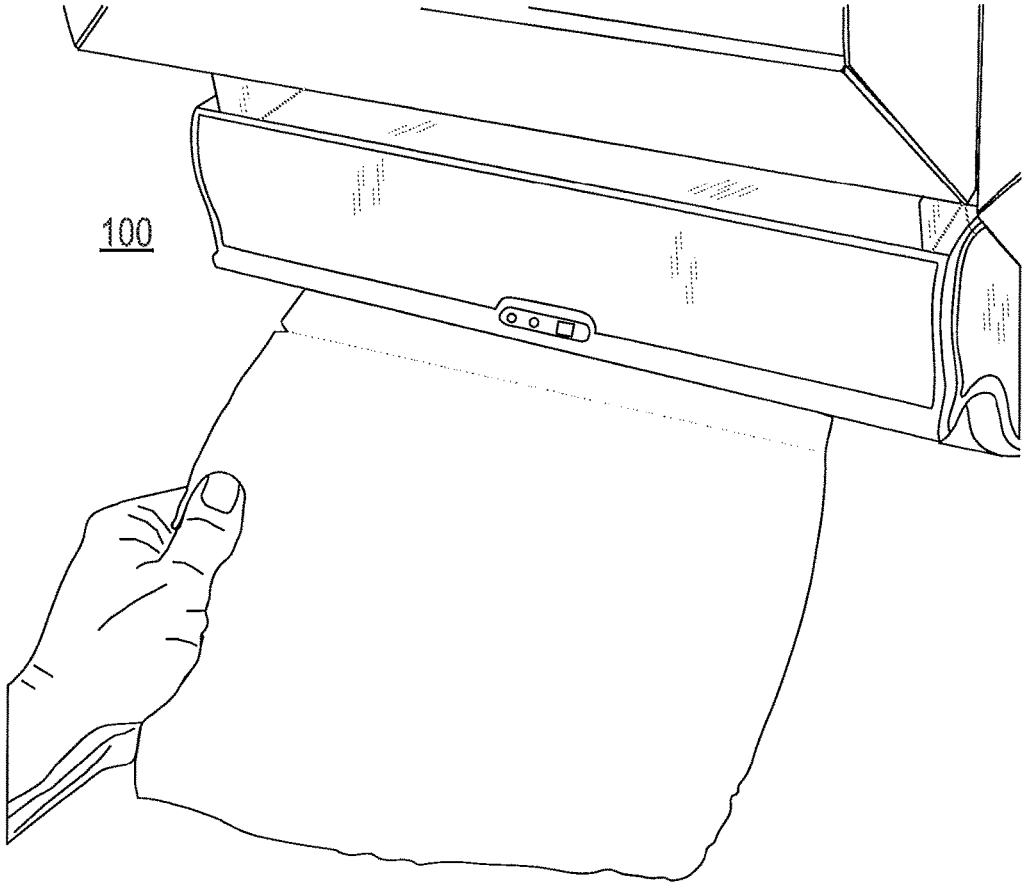
FIG. 10 is a partial perspective view of an automatic paper towel dispenser apparatus in accordance with an embodiment of the invention, in which the automatic paper towel dispenser is installed under a cabinet and a user is in the process of tearing the toweling.
Figure 11:
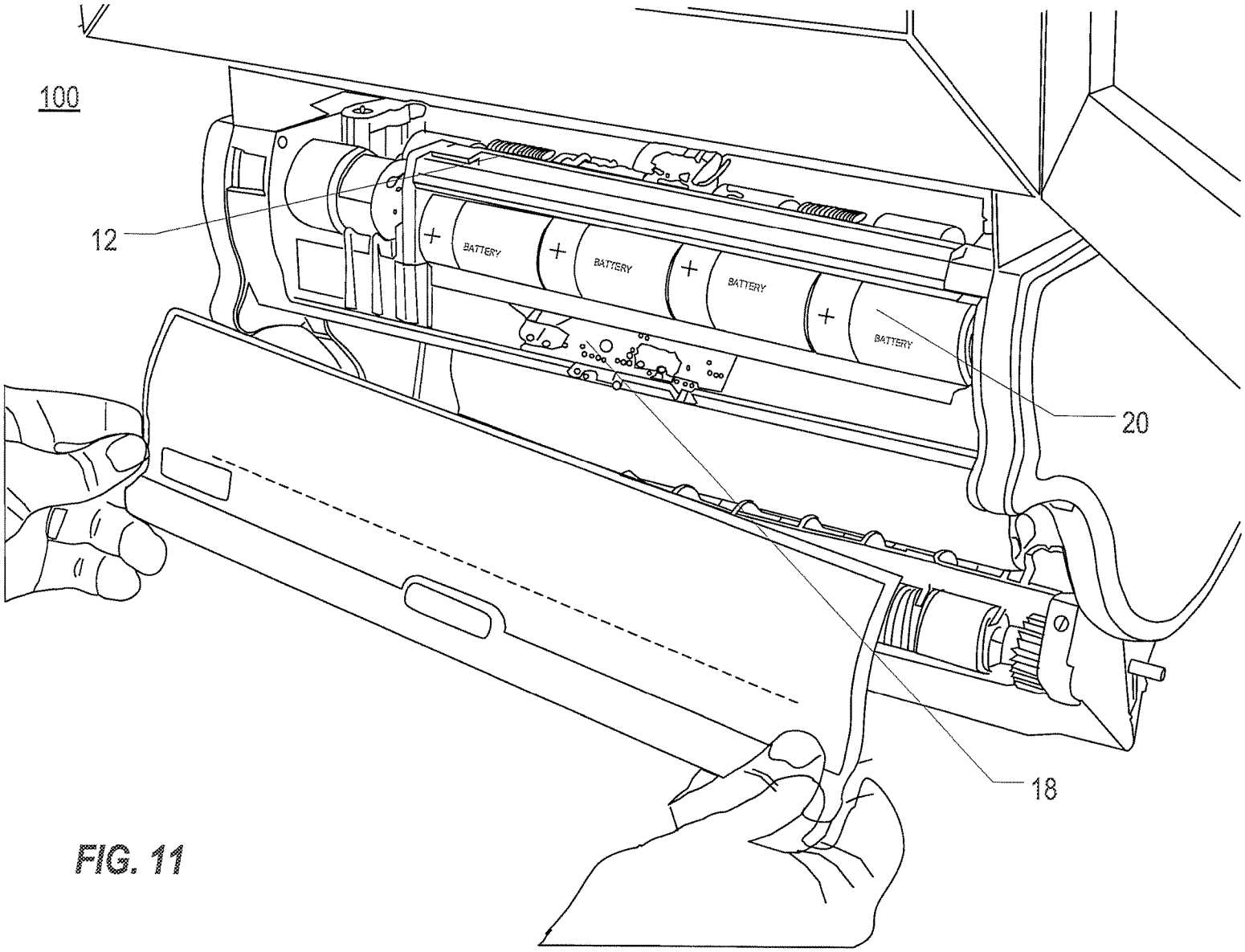
FIG. 11 is a partial perspective view of an automatic paper towel dispenser apparatus in accordance with an embodiment of the invention, in which the front cover of the automatic paper towel dispenser apparatus has been removed for access to the batteries, which comprise 4 D cells.
Figure 14A:
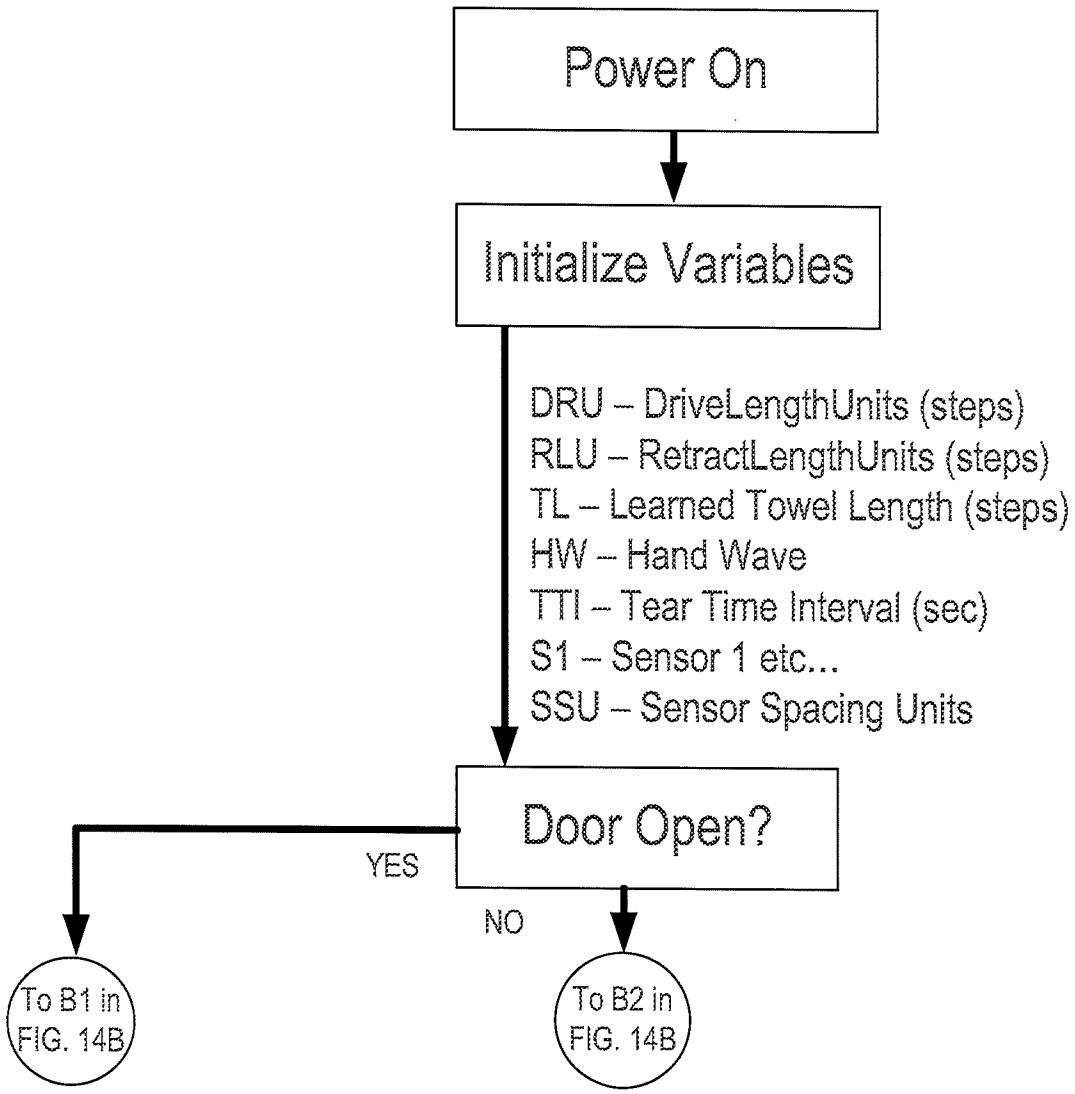
FIGS. 14A and 14B collectively illustrate a block diagram representing operational logic in accordance with an embodiment of the invention.
Figure 14B:
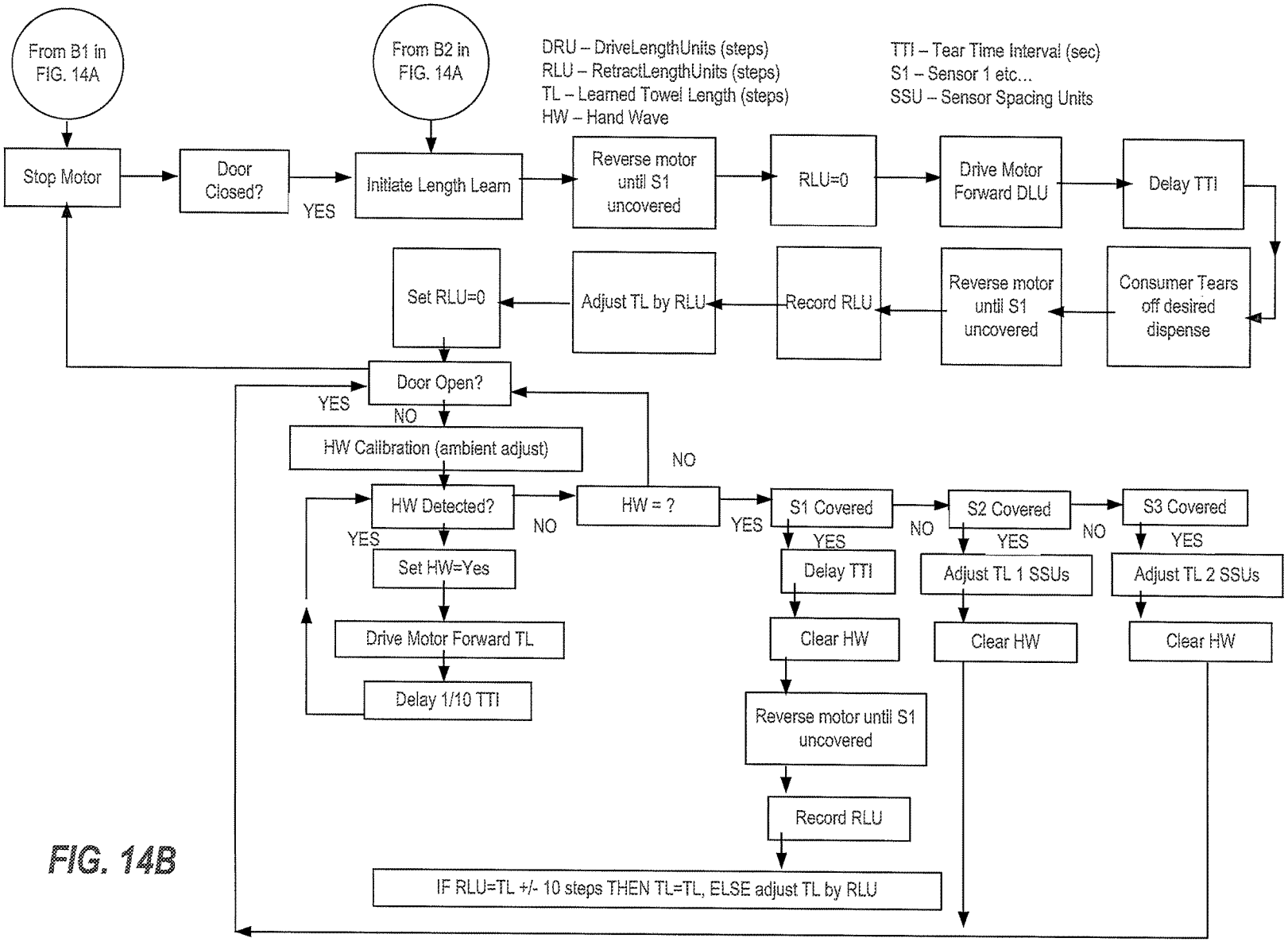
Figure 15A:
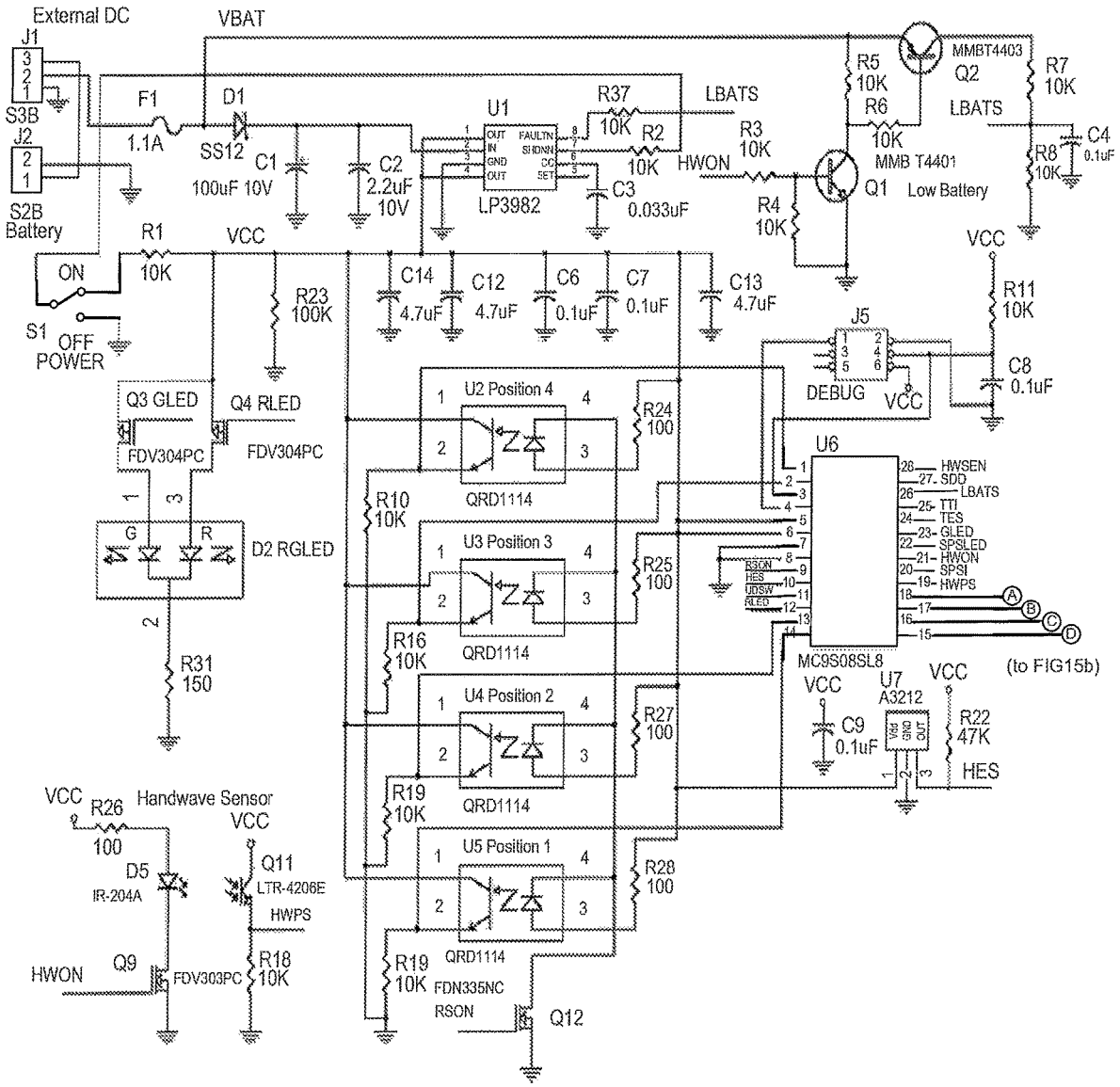
FIGS. 15A and 15B, and FIG. 15C each represents an exemplary electronic schematic diagram for control circuitry utilized in different embodiments of automatic paper towel dispenser apparatus in accordance with the invention.
Figure 15B:
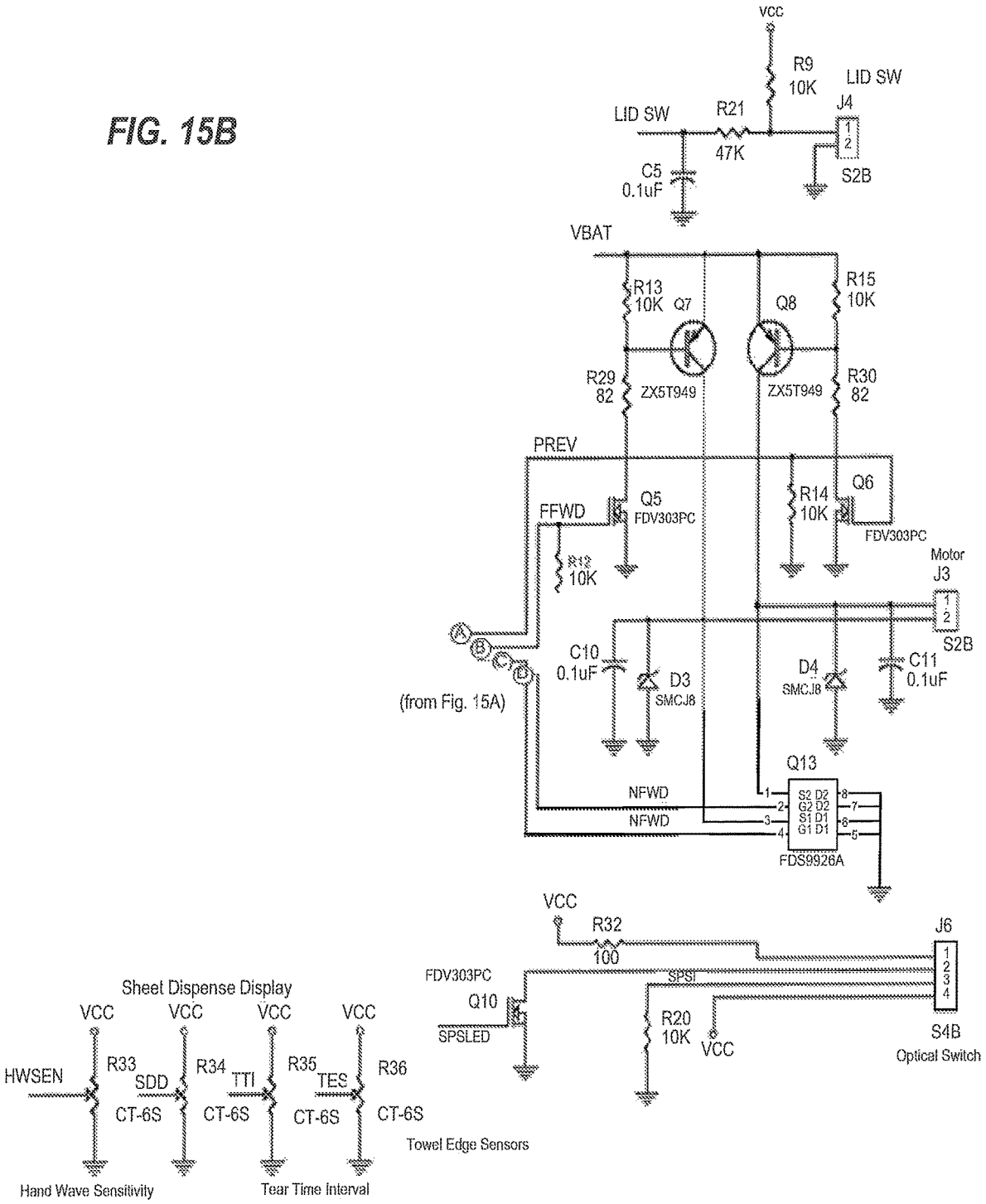
Figure 15C:
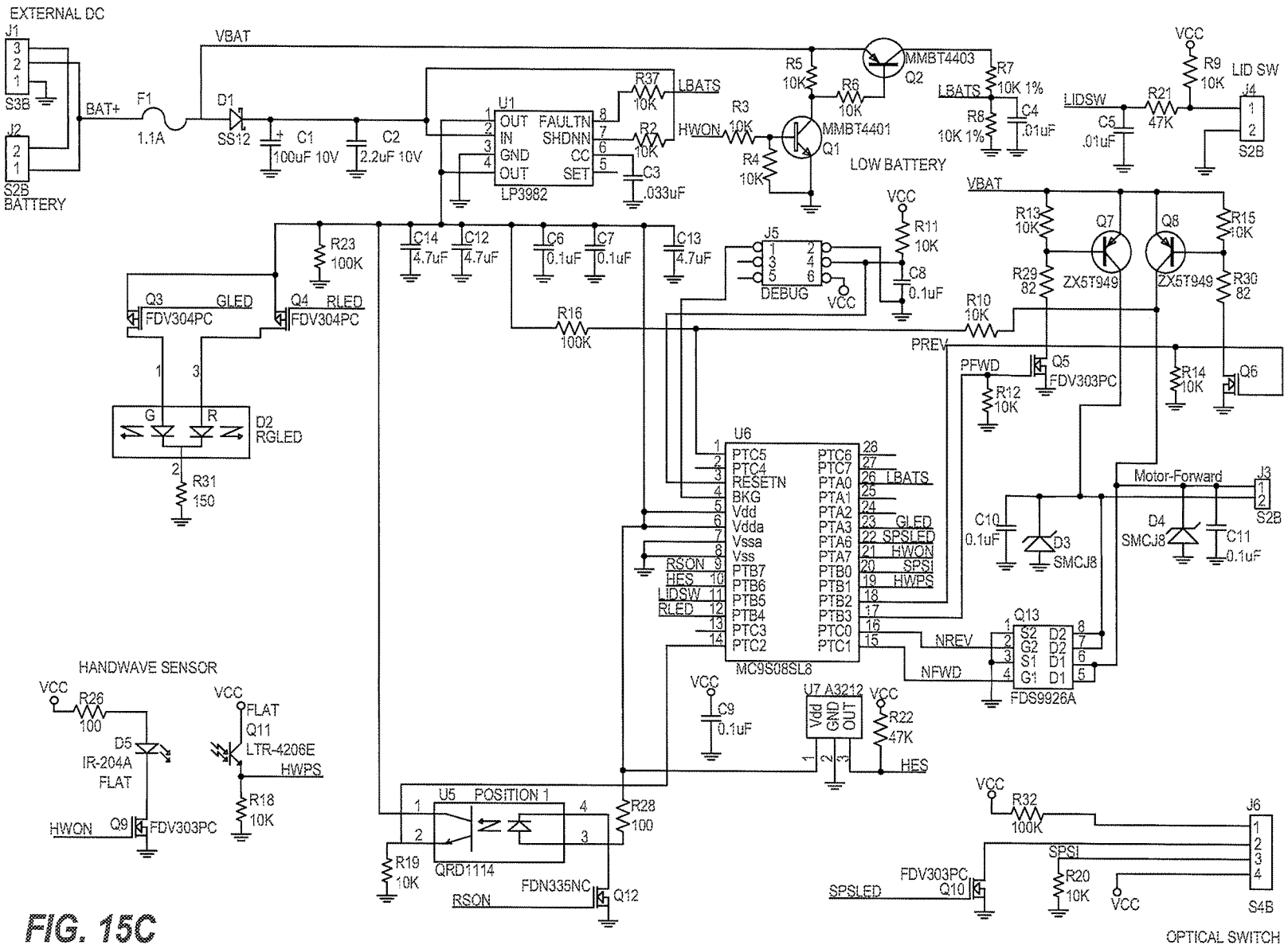
Figure 16:
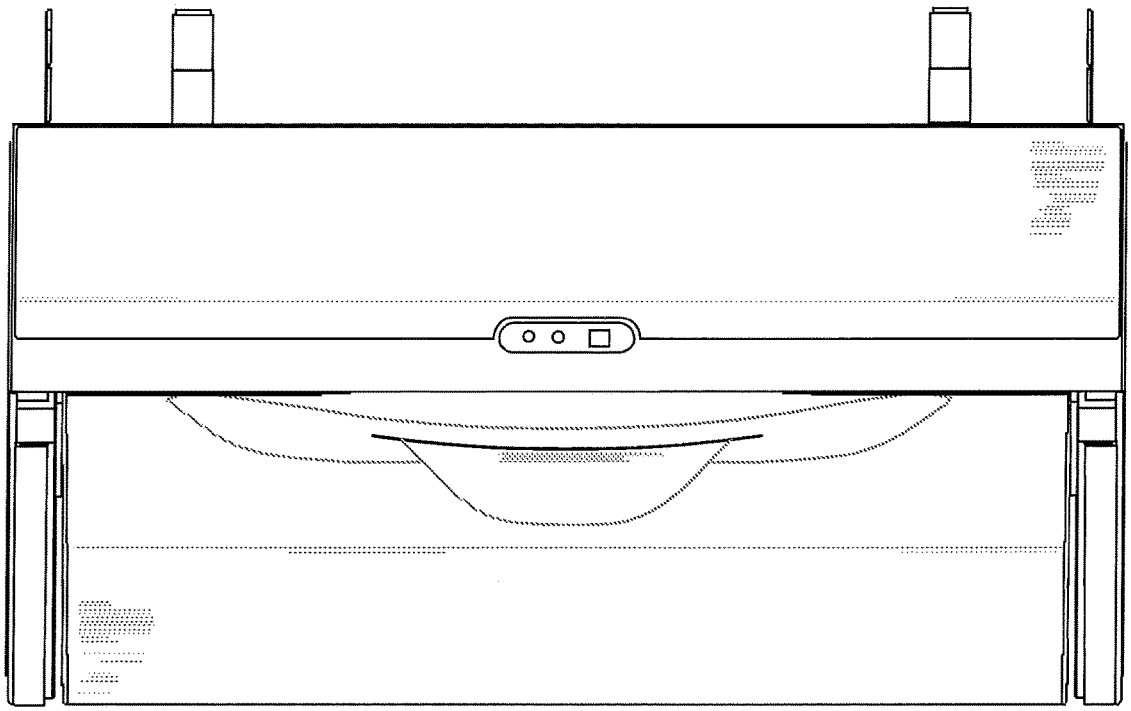
FIG. 16 is a front elevation view of part of an automatic paper towel dispenser apparatus in accordance with an embodiment of the invention.
Figure 17:
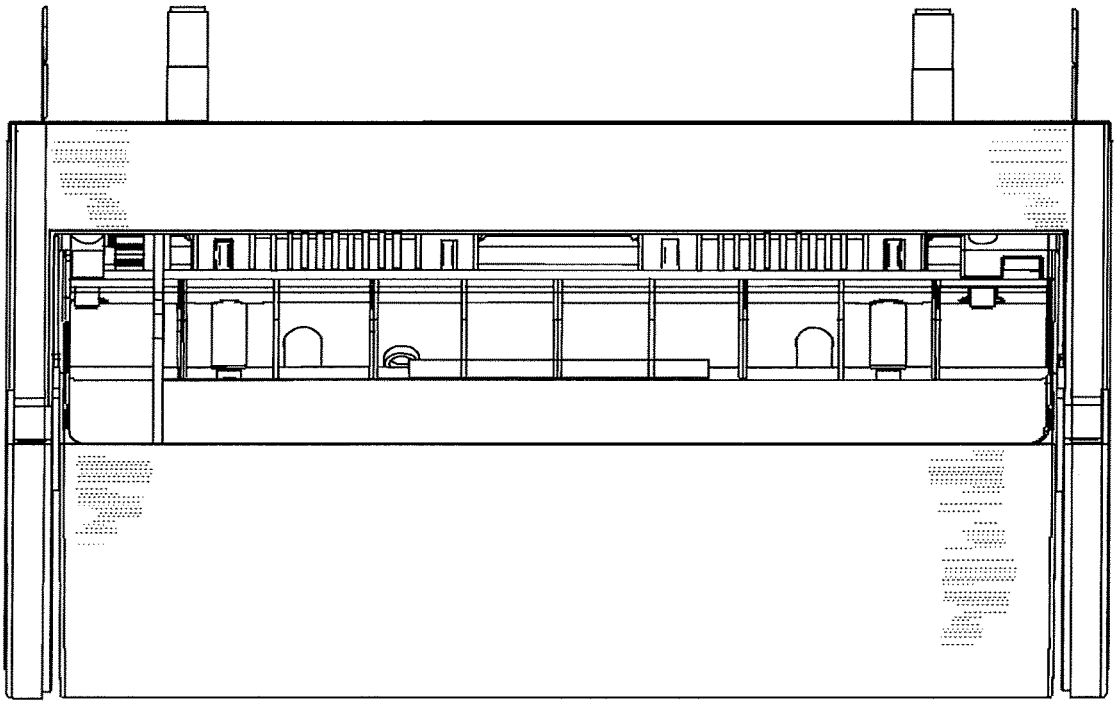
FIG. 17 is a rear elevation view of part of the automatic paper towel dispenser apparatus of FIG. 16.
Figure 20A:
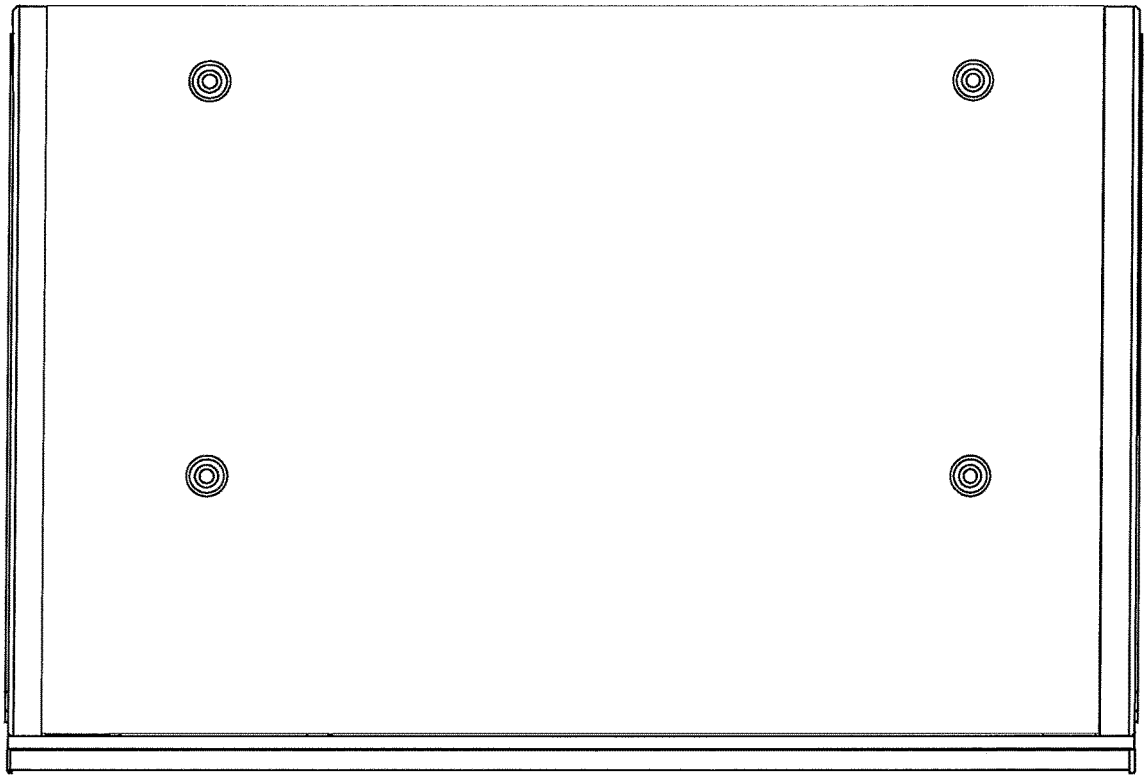
FIG. 20A is a top plan view of part of the automatic paper towel dispenser apparatus of FIG. 16.
Figure 20B:
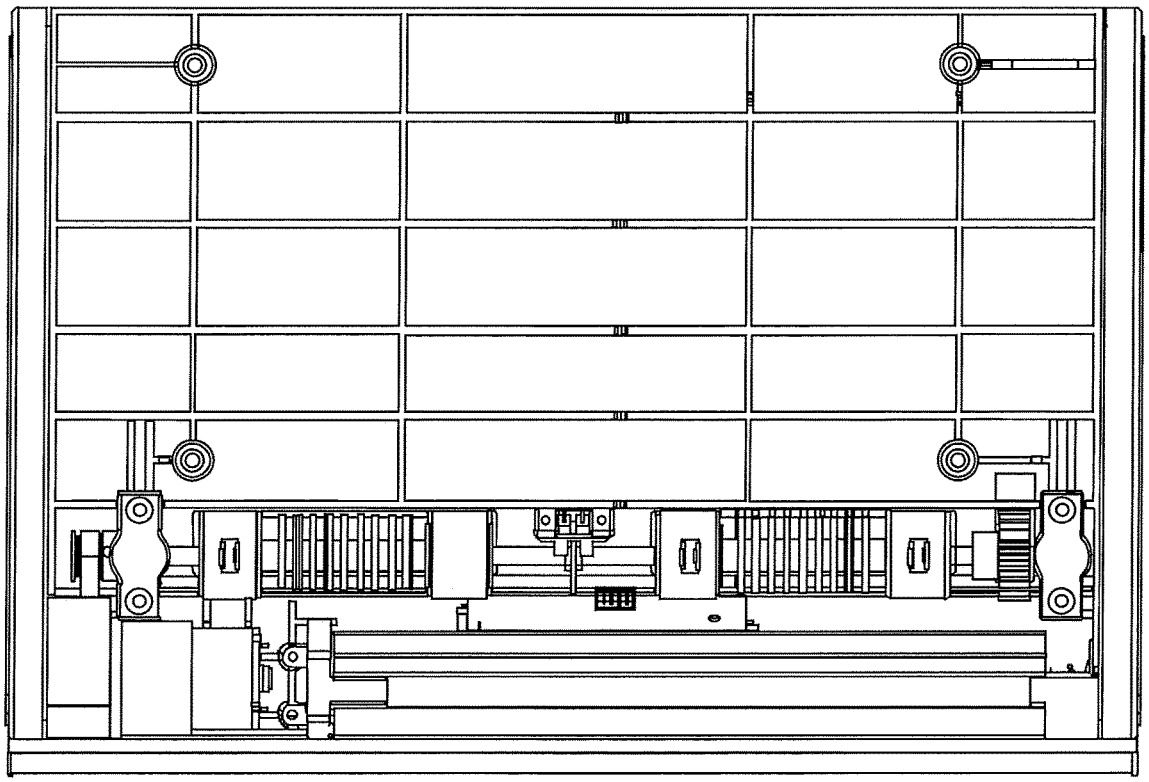
FIG. 20B is the same view with the top panel omitted.
Figure 21:
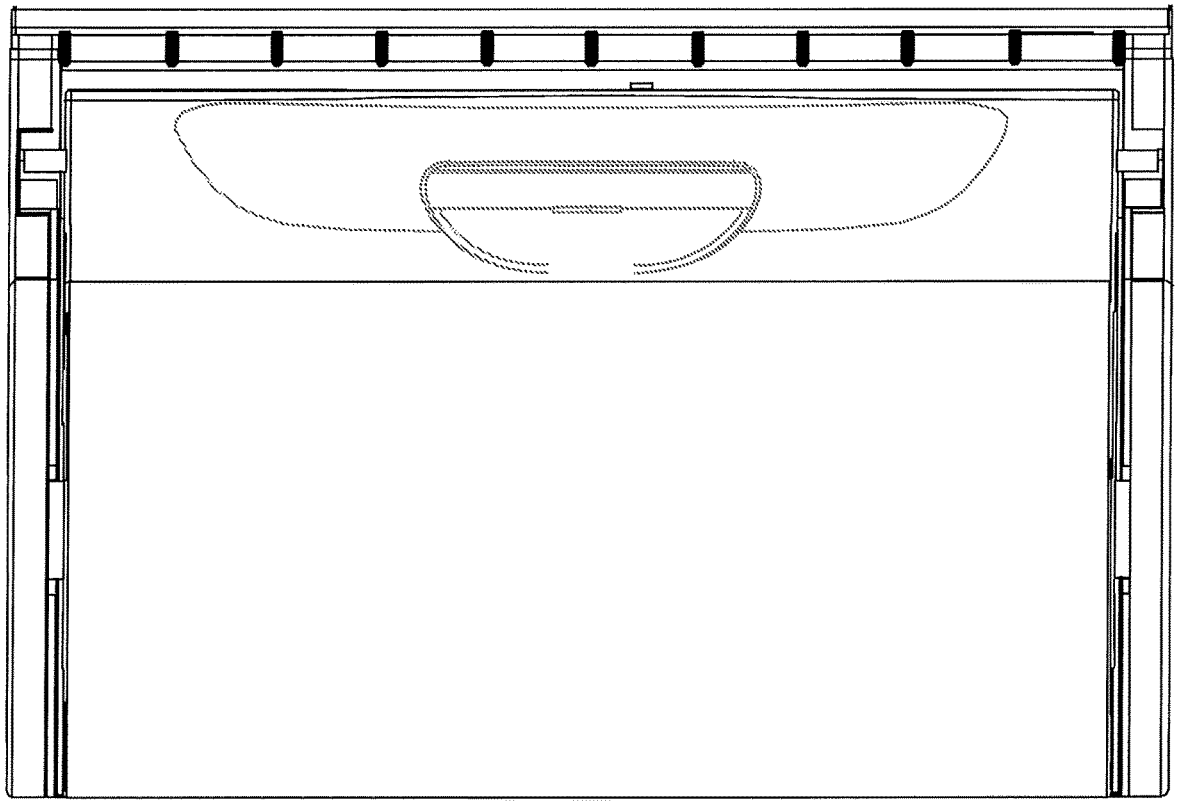
FIG. 21 is a bottom plan view of part of the automatic paper towel dispenser apparatus of FIG. 16.
Figure 22A:
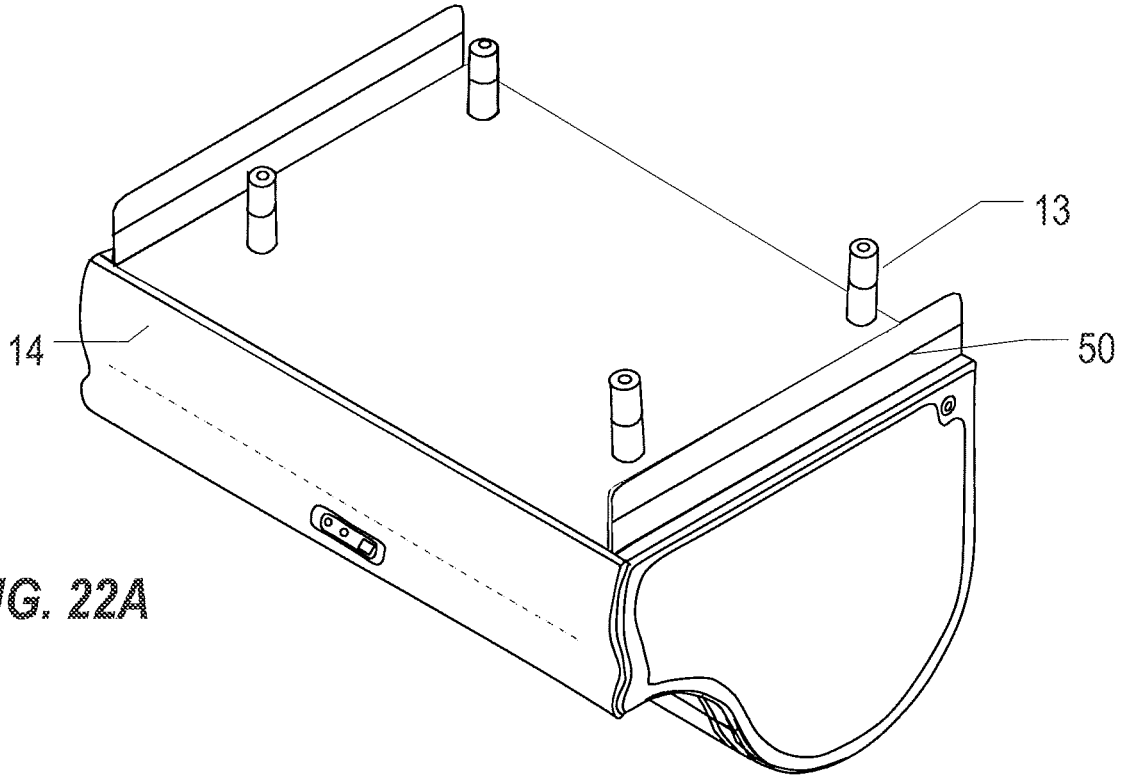
FIG. 22A is an isometric view of part of the automatic paper towel dispenser apparatus of FIG. 16.
Figure 22B:
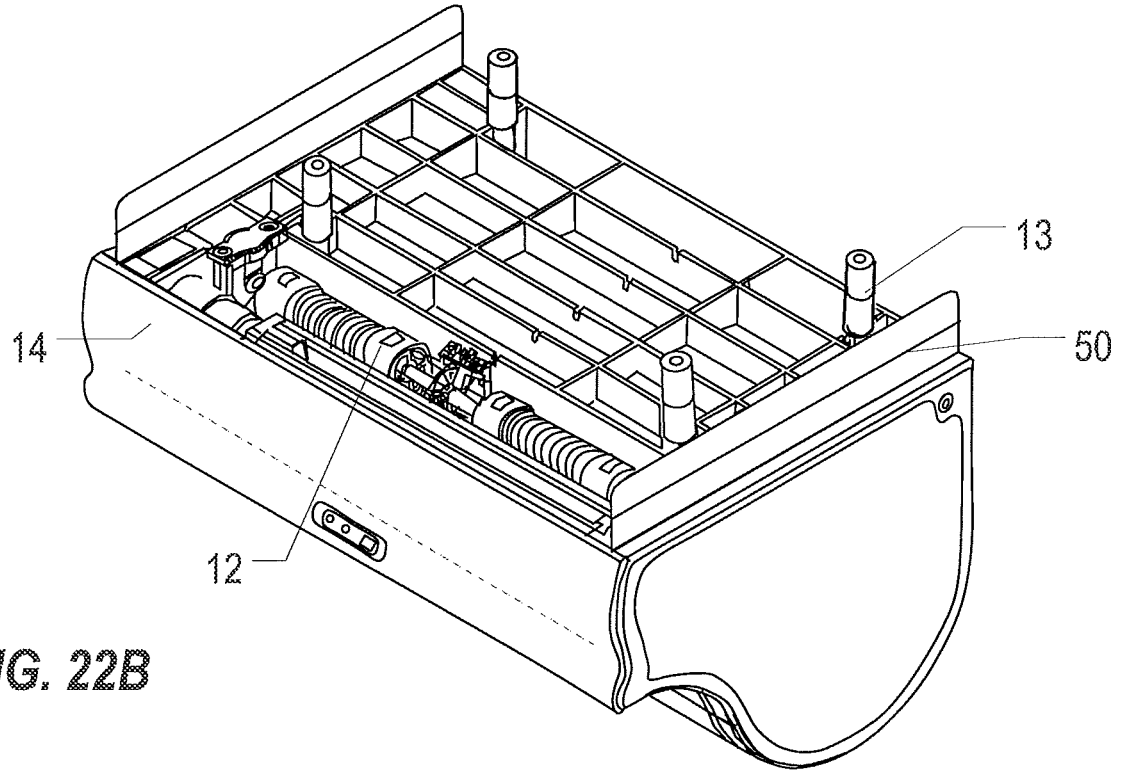
FIG. 22B is the same view with the top panel omitted.

FIGS. 7-9 are photographs showing steps in a sequence of installing toweling into an automatic paper towel dispenser apparatus 100 in accordance with an embodiment of the invention. FIGS. 14A and 14B collectively illustrate a block diagram describing operational logic that is implemented in the automatic paper towel dispenser apparatus 100; and FIG. 15A and FIG. 15B show an electronic schematic diagram for control circuitry that may be utilized in automatic paper towel dispenser apparatus in accordance with at least one embodiment of the invention. FIG. 15C is an alternative electronic schematic diagram for control circuitry that may be utilized in automatic paper towel dispenser apparatus in accordance with at least one other embodiment of the invention, wherein, inter alia, a single position sensor is utilized.

A latch mechanism is released to open apparatus 100. This latch is operated by a sliding pull handle located on the underside of the front section of the dispenser. FIG. 7 shows the apparatus 100 in the open position and ready to accept a roll of paper towels. The lower driver roller moves with the towel carrier. This feature greatly simplifies installation of the toweling. In conventional dispensers, tensioning devices and a convoluted feeding route need to be understood by the operator. In apparatus 100, the operator simply installs a roll of towels with the first towel draped over the lower drive roller and closes the device. There is no requirement for the toweling to be threaded through any path defined by rollers and tensioning devices.

Included in the rotating towel carrier subassembly is a magnet that interfaces with a hall-effect transducer resident on the main circuit board. Output from the hall-effect transducer notifies the microcontroller of the position of the towel carrier door. Each time the door is opened, the device is reset. Upon closing the door, the microcontroller initiates a "Length Learn" program sequence.

With particular regard to the "Length Learn" program sequence, the apparatus 100 first retracts the toweling until output from the "S1" positioning reflective IR sensor indicates that no paper is present, i.e., that a leading edge of the toweling has been sensed. This reflective sensor is located at the front and top of the dispensing slot. It is mounted to the main circuit board, and protrudes through an opening that keeps it flush with the dispensing slot top surface. In at least some preferred implementations, a surface opposite the reflective sensor includes one or more holes or openings to prevent reflections off of dispenser components from being an issue. Position of the towel's edge has now been determined. Preferably, a known length, such as twelve inches of paper towel, is then dispensed although a greater length may be dispensed, especially if the user desired dispensing of more than one towel at a time.

The length of toweling that is dispensed is determined by driving the motor in the forward direction a predetermined number of encoder counts, or "Drive Length Units". Length corresponds to counts. Counts correspond to both edges of openings in a slotted wheel axially mounted to the top roller shaft. Output from a slot type IR sensor, TT Optek OPB891T51Z, is used by the microcontroller to count. In a preferred implementation, there are 32 counts per revolution with a 16 slot wheel.

A pause in the program, referred to as the "Tear Time Interval", allows an operator to interact with the dispenser. Towel length for all subsequent dispensing is determined by tearing off a length of towel at any desired perforated position. "Tear Time Interval" concludes and the dispenser again retracts until the reflective IR sensor detects the leading edge of the toweling. While reversing, the microcontroller again uses the encoder to count openings in the slotted wheel, sometimes referred to as an encoder pinwheel. "Retract Length Units", reverse counts, are used to determine "Learned Towel Length", whereupon the "Length Learn" program sequence is completed. The Learned Towel Length or LTL is determined by subtracting the Retract Length Units or RLU from the Drive Length Units or DLU.

It further will be appreciated that technology other than an encoder pinwheel may be used as an alternative for measuring the extent to which the toweling is extended or retracted by the motor. For example, the technology conventionally found in an optical mouse may be utilized, which includes a tiny camera that takes thousands of pictures per second to detennine position and speed. Conventionally, the optical mouse uses a very small light emitting diode more commonly referred to as an LED which is red in color. This LED bounces light off of a mouse pad or desk surface onto a CMOS (Complementary Metal Oxide Semiconductor).

In the context of the present invention, this same technology may be used to determine the extent of the toweling that is extended or retracted. In operation, the LED produces a red light that is emitted onto the toweling surface. The light is reflected off the surface back to the CMOS sensor. The CMOS sensor sends each image that is reflected back to a DSP (Digital Signal Processor) for analysis. Using the thousands of images (taken at hundreds of times per second) that the CMOS sends to the DSP for analysis, the DSP is able to detect both patterns and images and can determine if the toweling has moved, at what distance it has moved, and at what speed.

Yet another alternative technology includes that found in laser-based optical mice, which technology piggy backs off of the LED optical mouse. The laser based optical mouse works similar to the LED based optical mouse. It uses a laser instead of a LED. The benefit is that because it uses a laser beam, the mouse can track much better, giving the user ultimately better response times, tracking and the ability for such a mouse to be used on even more surfaces. In the context of the present invention, it is believed that use of such laser technology would provide greater precision and accuracy in determining the extent of the toweling that is extended or retracted.

Furthermore, the housing in the area of the detection of the toweling surface preferably is dark and contrasts well with the toweling so as to better define the leading edge of the toweling for detection, whether the IR, optical or laser technology is used.

After the LTL is learned, the operator engages the "Hand Wave" sensor to dispense a towel. The reflective IR sensor shown in the drawings is interfaced with through a lens located in the center of the front fascia panel. The sensor emitter and detector are mounted directly to the main circuit board. Therefore, they do not move with the removable fascia panel. As a result, their placement, and proper installation of the fascia panel, is important to check for correct operation.

After the "Length Learn" sequence is completed, the dispenser's microcontroller enters a program that constantly looks at the "Hand Wave" sensor for output. Some level of ambient IR light is always present. Also, people and objects may continually pass in front of the device with no intention of initiating towel dispensing. Preferably, "Hand Wave" sensor output voltage is sampled and compared to avoid false initiation. The sample rate may be every 10 milliseconds, for example.

When an operator or user intends to dispense a towel, "Hand Wave" sensor voltage is substantially higher than ambient for a determined number of samples. At this point the motor is driven forward the "Learned Towel Length". To accommodate possible additional towels being desired by the user, the program delays for one tenth of the "Tear Time Interval", then reviews the "Hand Wave" sensor output. If a hand is still present, the toweling is extended an additional LTL. This additional dispensing sub-sequence will continue until a hand is no longer detected by the "Hand Wave"

sensor. When a hand is no longer detected by the "Hand Wave" sensor, the "Tear Time Interval" is initiated, during which the operator is expected to tear off the desired paper towels from the dispensed toweling. After the "Tear Time Interval", the motor is driven in reverse until the positioning sensor "S1" again detects the leading edge (i.e., presumed new leading edge) of the toweling.

Alternatively, the motor is driven forward the number of desired LTLs (e.g., 1 LTL, 2 LTLs, or 3LTLs), plus a predetermined additional extent. The predetermined extent may be, for example, a distance between the point at which the leading edge of the toweling is detected by the sensor, and a point exterior of the housing and proximate to area at which the toweling exits the housing. In accordance with this alternative, a line of perforations should be found each time a towel is dispensed at a point exterior of the housing and proximate the area at which the toweling exits the housing. As such, a small extent of the toweling following separation of the dispensed towels will be left extending outside of the housing and will be retracted back into die housing to the point at which the leading edge of the toweling is detected by the sensor. In accordance with this alternative, an operator will be able to clearly observe the particular line of perforations along which the tear is made.

Normal dispensing by the apparatus continues until all the towels on the roll have been dispensed, or until a dispensing error occurs.

All errors result in the bi-color indicator LED lighting red. An operator must open the device to reset the error condition. After any error, the "Length Learn" program will run again and the operator must teach the dispenser the desired dispense length.

Reliable paper feeding, without a specific paper to optimize the system around, is not trivial. Variations in thickness, friction coefficient, strength, surface area, and cross section must all be accommodated. Moreover, paper is removed by pulling with sufficient force to break the roll at a perforation, and this force also must be accommodated.

Several features have been designed to prevent malfunction, improve paper feed ability, and reliable operation. In particular, at least three main reliability features are provided in the apparatus 100 that are intended to prevent malfunction, improve paper feed ability, and reliable operation. Furthermore, it should be understood that, while embodiments of the invention may include only one or two—or none—of these features, other embodiments of the invention may include all three of these features.

The first reliability feature of the mechanism allows the upper drive roller to travel vertically. Two springs hold the roller in its lowest position. When the towel carrier is closed, the lower drive roller dictates the upper drive roller's position. This addresses different towel thicknesses that will tend to push the upper roller to slightly different positions. With the spring loaded drive roller, thickness variations throughout the roll are constantly accounted for. This also addresses inherent manufacturing dimensional variation, within tolerances, that otherwise affects feed reliability, especially when injected molding with plastics.

The second reliability feature prevents unwanted movement of one or both rollers. Both rollers in this dispenser are driven. They are directly linked together (or directly interconnected) by a pair of axially mounted end gears. These gears have fairly large and forgiving tooth geometry. This is important, because of the unique ability to separate the rollers during paper installation. Opening the rollers enough for the entire roll to pass between them separates the gears completely. They must re-mesh, without damage or perceived difficulty, when the dispenser is closed.

The third reliability feature is software based. During the "Tear Time Interval" the motor has a percentage of the stall current applied in reverse. This applies force to the drive mechanism, preventing its movement, and allowing a very positive feel as the towel's perforation is broken by the user pulling on the toweling portion extending from the housing. Indeed, even slow and consistent pull on the extended toweling does not further extend toweling from the dispenser due, at least in part, to the application of reverse current.

Figure 23:
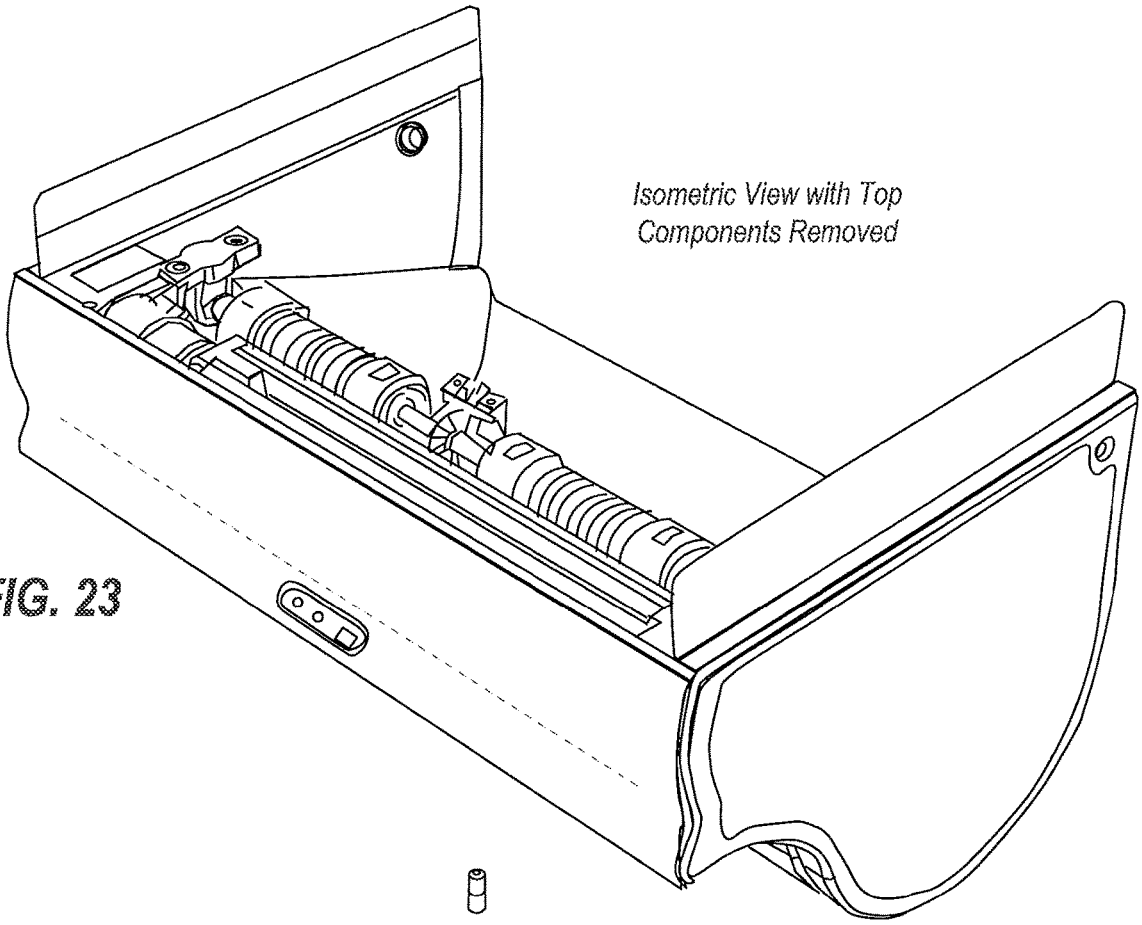
FIG. 23 is an isometric view of part of the automatic paper towel dispenser apparatus of FIG. 16.
Figure 24:
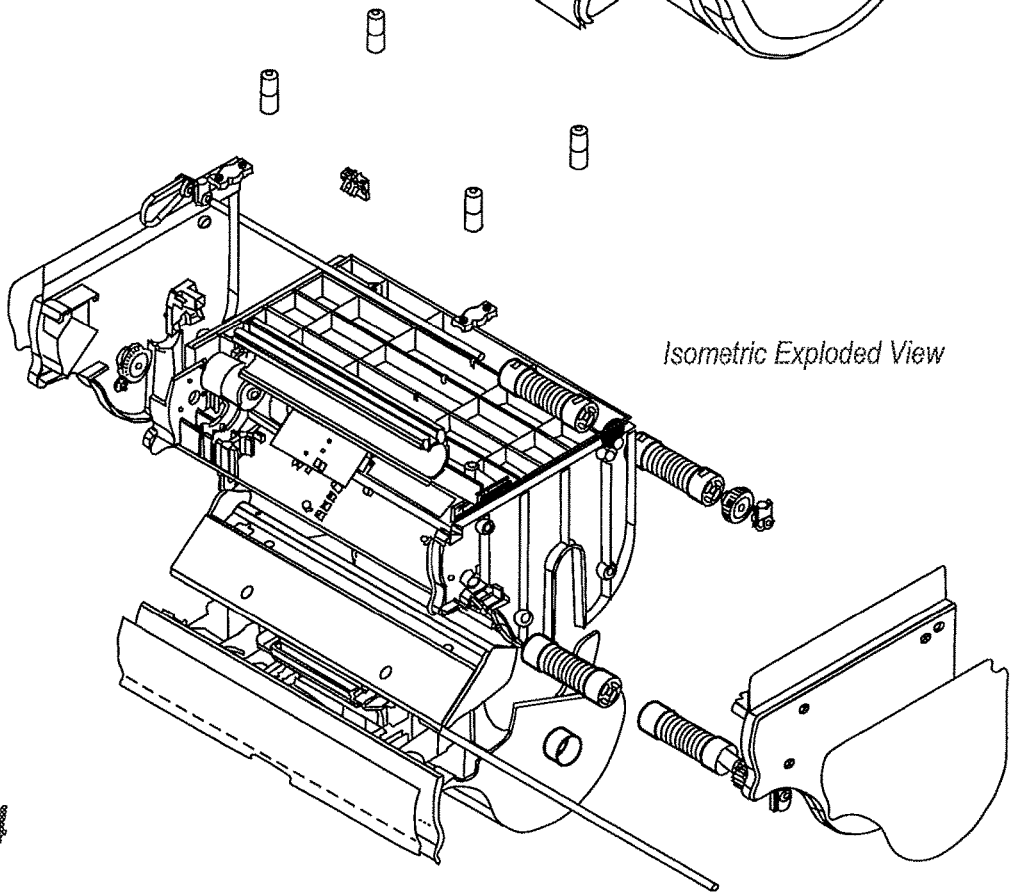
FIG. 24 is an exploded, isometric view of part of the automatic paper towel dispenser apparatus of FIG. 16.

Yet another automatic paper towel dispenser apparatus 200 in accordance with an embodiment of the invention is illustrated in FIGS. 16A through 23B. Operation and structure of apparatus 200 is similar to those disclosed above. Of additional note, FIG. 23A and FIG. 23B illustrate the open area within the housing, over the space for receiving a roll of paper towels, into which area toweling that is retracted into the housing may be directed. Moreover, if too much toweling is retracted into this area, the excess toweling likely falls out of the back of the apparatus, thereby avoiding possible jamming of the apparatus 200. To this end, the back of the housing preferably is open when the door is closed, as shown in FIG. 23A and FIG. 23B.

Figure 25:
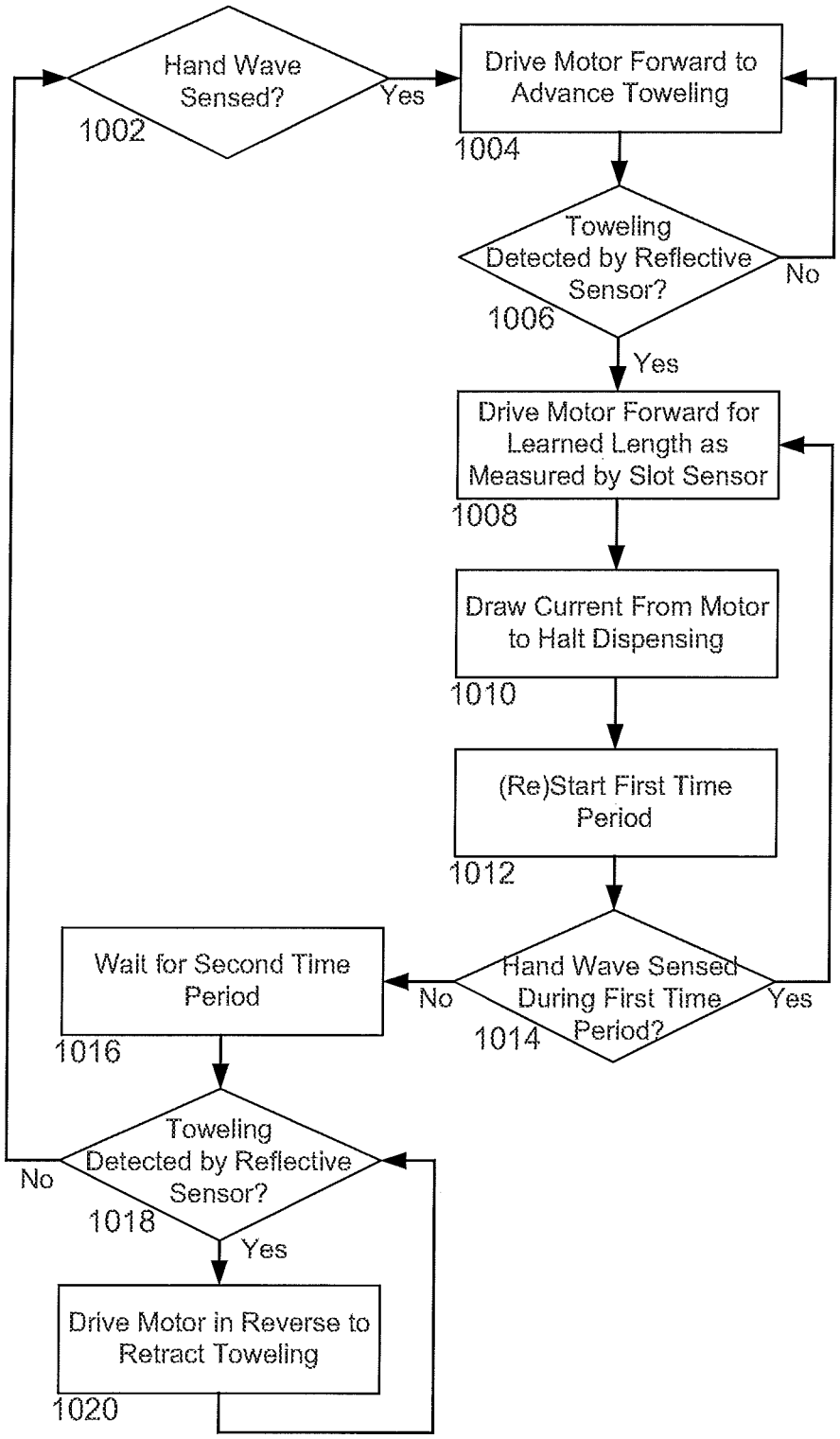
FIG. 25 is a flowchart detailing exemplary functionality of a paper towel dispenser apparatus in accordance with one or more embodiments of the invention.

Additional description of structure and functionality in accordance with one or more embodiments will now be provided, first with reference to the exemplary flowchart of FIG. 25, and then with reference to FIGS. 26-34.

In one or more embodiments, an automatic paper towel dispenser apparatus is configured to, after learning how long a paper towel of a paper towel roll is, dispense one or more paper towels via a dispensing opening. Such dispenser apparatus includes a hand wave sensor configured to sense the wave of a user's hand. The dispenser apparatus is configured such that, when a first hand wave is detected at step 1002, toweling begins to be advanced at step 1004 by providing current to a motor assembly configured to drive the dispensing of toweling.

As the toweling is advanced, a leading edge of the toweling, i.e. a leading edge of the first paper towel, is detected at step 1006 by a reflective sensor the toweling travels past prior to passing through the dispensing opening. This reflective sensor preferably operates by determining whether emitted light is reflected by toweling, e.g. white toweling.

Following detection of this leading edge, an extent determined based on a learned length of toweling is advanced at step 1008. The advancing of exactly this extent is preferably provided via use of a slot sensor. The slot sensor comprises an emitter, a detector disposed opposite the emitter, and a rotatable disc disposed therebetween. The rotatable disc includes a plurality of slots disposed therein. As toweling is advanced, the rotatable disc rotates, and, as the slots and non-slot sections pass between the emitter and receptor, light emitted by the emitter is intermittently received by the receptor. The slot sensor is configured to determine, based on the intermittent reception of light by the receptor, the amount of rotation of the rotatable disc, and thus the amount of toweling advanced. Once, following detection of the leading edge, the desired extent of toweling based on a learned length of toweling has been advanced, current is drawn from the motor assembly to halt dispensing at step 1010. In at least some embodiments, upon halting of dispensing, a perforated line separating the first paper towel from a next paper towel is disposed at, on, under, and/or proximate to the reflective sensor. In at least some other embodiments, an additional offset is added to or subtracted from a learned towel length such that such perforated line is disposed upstream of, or downstream of, the reflective sensor.

Preferably, the dispenser apparatus is further configured such that, following halting of dispensing, a first time period begins at step 1012. This time period is preferably measured by a timer, and preferably lasts around one second. At any time prior to the end of this time period, a subsequent hand wave will trigger advancement of an additional extent of toweling based on a learned length. Preferably, such a subsequent hand wave will also result in the resetting or restarting of the first time period, thereby providing additional time for yet another hand wave, although, in at least some embodiments, this is not the case. In this way, a user is able to trigger dispensing of any number of paper towels that they wish, via, for example, that number of hand waves, or by continually leaving their hand in front of the hand wave sensor until a desired number of paper towels have been dispensed. In an embodiment, during this first time period, an indicator disposed proximate the hand wave sensor displays a first color, e.g. red.

Preferably, following expiration of this first time period, a second time period begins. This second time period is preferably also measured by a timer, and preferably lasts around four seconds. During this second time period, hand waving by the user does not trigger the dispensing of any additional paper towels. In an embodiment, during this second time period, an indicator disposed proximate the hand wave sensor displays a second color, e.g. orange.

This second time period is intended to allow a user to tear off one or more dispensed paper towels. It will be appreciated that, when a user goes to tear off one or more dispensed paper towels, force applied by the user could cause the withdrawal of additional toweling from the dispenser apparatus, barring any mechanism for the prevention of such additional withdrawal. In an embodiment, the slot sensor is utilized in combination with the motor assembly to mitigate, or prevent, any such withdrawal, via the use of a "fight sequence". Preferably, the slot sensor is utilized to determine whether additional toweling has been withdrawn, via the detection of rotation of the rotatable disc of the slot sensor. In the event of such rotation, current, having an opposite polarity to that described hereinabove (sometimes referred to herein as reverse polarity current), is preferably provided to the motor assembly to return the slot sensor to its prior position (e.g. the position it was in prior to rotation of the slot sensor caused by a user attempting to tear off one or more dispensed paper towels).

The second time period is represented by step 1016. Upon expiration of the second time period, the reflective sensor disposed proximate the dispensing opening determines whether or not toweling is sensed at step 1018. If the reflective sensor senses toweling, then the toweling is retracted by providing reverse polarity current to the motor assembly at step 1020. The toweling is preferably retracted until the reflective sensor no longer senses toweling.

Following this, the dispenser apparatus is ready to once again detect a user's initial hand wave at step 1002.

FIGS. 26-34 illustrate an exemplary dispensing sequence for a paper towel dispenser apparatus in accordance with one or more embodiments of the invention.

Figure 26:
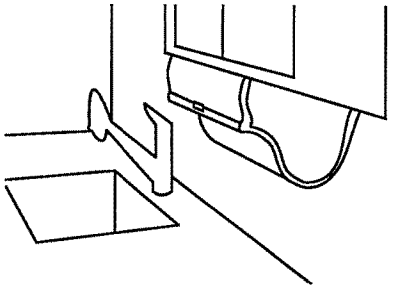
FIGS. 26-34 illustrate an exemplary dispensing sequence for a paper towel dispenser apparatus in accordance with one or more embodiments of the invention.
Figure 27:
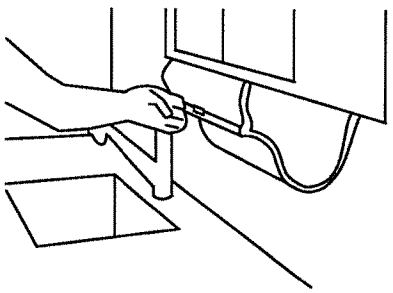
Figure 28:
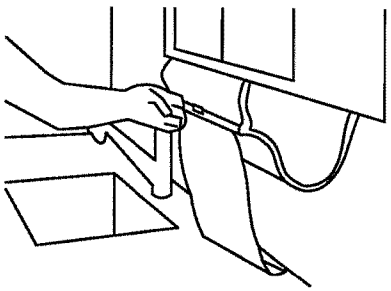
Figure 29:
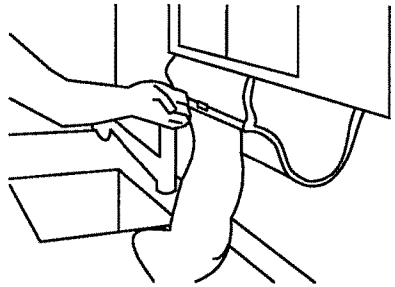

FIG. 26 illustrates a paper towel dispenser apparatus. To dispense toweling, a user triggers a hand wave sensor of the dispenser apparatus using their hand, as illustrated in FIG. 27. Upon detecting the user's hand via the hand wave sensor, the dispenser apparatus dispenses a learned towel length. After dispensing the learned towel length, the dispenser apparatus determines whether the user's hand is still present, or if the user has waved his hand again. If so, the dispenser apparatus dispenses an additional learned towel length. In this way, a user can effect dispensing of multiple learned towel lengths by leaving his hand in front of the hand wave sensor, as illustrated in FIGS. 28-29.

Figure 30:
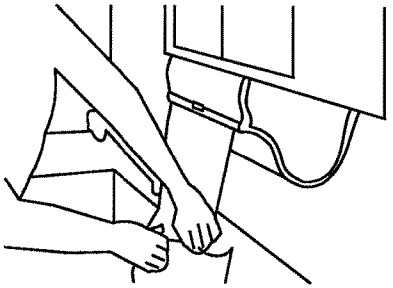
Figure 31:
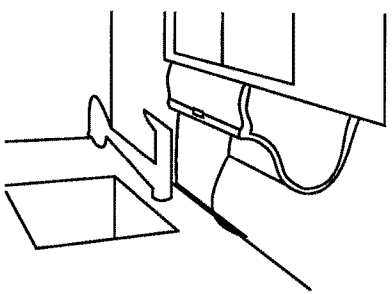
Figure 32:
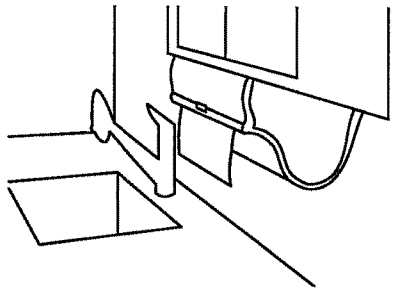
Figure 33:
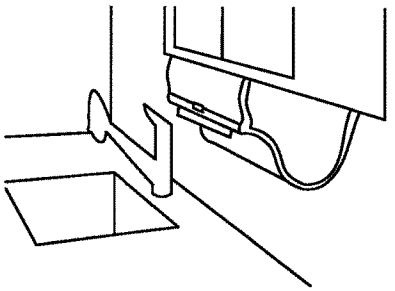
Figure 34:
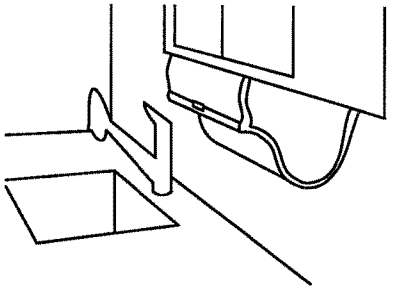

Once the user ceases triggering the hand wave sensor via their hand, then the dispenser apparatus will cease dispensing additional learned towel lengths. Upon this occurring, the dispenser apparatus will begin waiting a tear tune interval, thereby allowing the user to tear off one or more sheets of dispensed toweling. FIG. 30 illustrates a user tearing off a single sheet of dispensed toweling after dispensing a plurality of sheets of toweling. Upon expiration of the tear time interval, the sheets that were dispensed, but not torn off by the user, are retracted back into the dispenser apparatus, as illustrated in FIGS. 31-34.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested herein, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A sheet material dispenser comprising:

a housing defining an interior space sized to receive a sheet material roll therein;

an outlet for dispensing sheet material from the sheet material roll;

a sensor positioned proximate the outlet and configured to sense a leading edge of the sheet material from the sheet material roll;

a motor assembly that drives dispensing of the sheet material from the dispenser; and a controller configured to perform a length learn calibration by:

causing the motor assembly to dispense a first predetermined length of the sheet material through the outlet;

causing, in response to expiration of a predetermined period of time and based on sensor data from the sensor, the motor assembly to retract the sheet material through the outlet such that the leading edge of the sheet material is retracted within the housing;

determining a retracted length of the sheet material corresponding to the amount of sheet material that was retracted through the outlet; and determining a second predetermined length of sheet material to dispense through the outlet during future dispenses based on the determined retracted length and the first predetermined length.

2. The sheet material dispenser of claim 1, wherein the controller is configured to determine the second predetermined length by subtracting the determined retracted length from the first predetermined length.

3. The sheet material dispenser of claim 1 further comprising an activation sensor positioned on an external side of the housing and configured to detect an object or motion to cause initiation of a dispense of the sheet material.

4. The sheet material dispenser of claim 3, wherein the controller is configured to determine that the object or motion is detected by the activation sensor and, in response, cause the motor assembly to dispense the second predetermined length of the sheet material through the outlet.

5. The sheet material dispenser of claim 1, wherein the controller is configured to initiate the length learn calibration in response to user input indicating a desire to initiate the length learn calibration.

6. The sheet material dispenser of claim 1 further comprising a cover movably connected to the housing to define an open position and a closed position, wherein, when the cover is in the open position, the sheet material roll is able to be inserted into the interior space.

7. The sheet material dispenser of claim 6, wherein the controller is configured to initiate the length learn calibration in response to the cover moving to the closed position.

8. The sheet material dispenser of claim 1, wherein the controller is configured to initiate the length learn calibration in response to determining that a new sheet material roll has been installed in the interior space.

9. The sheet material dispenser of claim 1, wherein the sheet material defines a plurality of sets of perforations spaced apart at a sheet distance to define individual sheets that can be torn from the sheet material roll, wherein the first predetermined length of sheet material is greater than the sheet distance such that at least one full individual sheet is presented outside of the outlet for removal by a user.

10. The sheet material dispenser of claim 1 comprising a roller operatively connected to the motor assembly and positioned to engage the sheet material, wherein the motor assembly drives the roller in a first rotational direction to cause dispensing of the sheet material and in a second rotational direction to cause retracting of the sheet material.

11. The sheet material dispenser of claim 1, wherein the controller is configured to determine the retracted length of the sheet material using an encoder that measures a length of sheet material as it is retracted.

12. A method for performing a length learn calibration for dispensing a desired length of sheet material from a sheet material roll through an outlet of a sheet material dispenser, the method comprising:

causing a motor assembly of the sheet material dispenser to dispense a first predetermined length of the sheet material through the outlet of the sheet material dispenser;

causing, in response to expiration of a predetermined period of time and based on sensor data from a sensor, the motor assembly to retract the sheet material through the outlet, wherein the sensor is positioned proximate the outlet and configured to sense a leading edge of the sheet material from the sheet material roll;

determining a retracted length of the sheet material corresponding to the amount of sheet material that was retracted through the outlet; and determining a second predetermined length of sheet material to dispense through the outlet during future dispenses based on the determined retracted length and the first predetermined length.

13. The method of claim 12, wherein determining the second predetermined length comprises subtracting the determined retracted length from the first predetermined length.

14. The method of claim 12 further comprising determining, based on activation sensor data from an activation sensor, that an object or motion is detected and, in response, causing the motor assembly to dispense the second predetermined length of the sheet material through the outlet.

15. The method of claim 12 further comprising initiating the length learn calibration in response to user input indicating a desire to initiate the length learn calibration.

16. The method of claim 12 further comprising initiating the length learn calibration in response to a cover moving to a closed position, wherein the cover is movably connected to a housing of the sheet material dispenser to define an open position and the closed position, wherein, when the cover is in the open position, the sheet material roll is able to be inserted into an interior space of the housing.

17. The method of claim 12 further comprising initiating the length learn calibration in response to determining that a new sheet material roll has been installed in the sheet material dispenser.

18. The method of claim 12, wherein the sheet material defines a plurality of sets of perforations spaced apart at a sheet distance to define individual sheets that can be torn from the sheet material roll, wherein the first predetermined length of sheet material is greater than the sheet distance such that at least one full individual sheet is presented outside of the outlet for removal by a user.

19. The method of claim 12, wherein the sheet material dispenser comprises a roller operatively connected to the motor assembly and positioned to engage the sheet material, wherein the motor assembly drives the roller in a first rotational direction to cause dispensing of the sheet material and in a second rotational direction to cause retracting of the sheet material.

20. A method comprising:

advancing sheet material using a motor assembly of a sheet material dispenser;

determining, via a sensor, when a certain extent of sheet material has been advanced;

based on said determining when a certain extent of sheet material has been advanced, ceasing advancing of the sheet material such that a first length of sheet material is extended outside of a housing of the sheet material dispenser;

determining, via the sensor, that the length of sheet material extended outside of the housing has increased from the first length of sheet material; and in response to said determining that the length of sheet material extended outside of the housing has increased, applying force to the sheet material, via the motor assembly, to retract the sheet material such that the length of sheet material extended outside of the housing returns to the certain extent of sheet material.

* * * * *